US011020755B2

(12) United States Patent
Hirata et al.

(10) Patent No.: US 11,020,755 B2
(45) Date of Patent: Jun. 1, 2021

(54) FOAM DISPENSING CONTAINER

(71) Applicant: KAO CORPORATION, Tokyo (JP)

(72) Inventors: Tomohisa Hirata, Tokyo (JP); Hidesato Kizaki, Tokyo (JP)

(73) Assignee: KAO CORPORATION, Tokyo (JP)

( * ) Notice: Subject to any disclaimer, the term of this patent is extended or adjusted under 35 U.S.C. 154(b) by 0 days.

(21) Appl. No.: 16/664,301

(22) Filed: Oct. 25, 2019

(65) Prior Publication Data

US 2020/0055061 A1 Feb. 20, 2020

Related U.S. Application Data

(63) Continuation of application No. 15/531,288, filed as application No. PCT/JP2015/083474 on Nov. 27, 2015, now Pat. No. 10,478,834.

(30) Foreign Application Priority Data

Nov. 28, 2014 (JP) ..... JP2014-241538
Jun. 5, 2015 (JP) ..... JP2015-115150
Jun. 29, 2015 (JP) ..... JP2015-130405

(51) Int. Cl.
*B05B 1/02* (2006.01)
*A47K 5/14* (2006.01)
(Continued)

(52) U.S. Cl.
CPC ..... *B05B 1/02* (2013.01); *A47K 5/1205* (2013.01); *A47K 5/1217* (2013.01); *A47K 5/14* (2013.01);
(Continued)

(58) Field of Classification Search
CPC ..... A47K 5/1217; A47K 5/1205; A47K 5/14; A47K 5/16; B05B 1/02; B05B 7/0037;
(Continued)

(56) References Cited

U.S. PATENT DOCUMENTS 1,740,384 A 12/1929 Wright
2,779,514 A 1/1957 Kebel
(Continued)

FOREIGN PATENT DOCUMENTS

CH 186697 A 9/1936
CN 102639247 A 8/2012
(Continued)

OTHER PUBLICATIONS

Office Action dated Mar. 5, 2019 in Japanese Patent Application No. 2017-186425, with concise English translation.
(Continued)

*Primary Examiner* — Vishal Pancholi
*Assistant Examiner* — Bob Zadeh
(74) *Attorney, Agent, or Firm* — Oblon, McClelland, Maier & Neustadt, L.L.P.

(57) ABSTRACT

A foam dispensing container (100) has a container body (40) that reserves a liquid agent (L); a head part (30) that has an outlet (20), and dispenses the liquid agent (L) delivered from the container body (40) through the outlet (20) into foam; and a pump head part (32) that allows dispensing of a predetermined amount of the foamy liquid agent (foam) through the outlet (20) each time it accepts a user's operation. The outlet (20) is formed with a contiguous geometry narrowed from an intended shape. A foam, dispensed through the outlet (20) as a result of a single or multiple operations of the pump head part (32), is built up into the intended shape in a plan view seen in the dispensing direction.

19 Claims, 28 Drawing Sheets

(51) Int. Cl.

| | |
|---|---|
| ***B05B 11/00*** | (2006.01) |
| ***B05B 7/00*** | (2006.01) |
| ***A47K 5/12*** | (2006.01) |
| *A47K 5/16* | (2006.01) |

(52) U.S. Cl.
CPC ..... *B05B 7/0037* (2013.01); *B05B 11/3001* (2013.01); *B05B 11/3045* (2013.01); *B05B 11/3046* (2013.01); *A47K 5/16* (2013.01); *B05B 7/005* (2013.01)

(58) Field of Classification Search
CPC ..... B05B 11/3001; B05B 11/3046; B05B 11/3045; B05B 7/005
See application file for complete search history.

(56) References Cited

U.S. PATENT DOCUMENTS

| | | | | |
|---|---|---|---|---|
| 3,092,334 | A | 6/1963 | Peterson | |
| 3,572,591 | A | 3/1971 | Brown | |
| 4,865,257 | A | 9/1989 | Bailey | |
| 5,326,000 | A * | 7/1994 | Fuchs | B05B 11/3087 222/321.7 |
| 5,813,785 | A | 9/1998 | Baudin et al. | |
| 6,145,756 | A | 11/2000 | Kohls | |
| 6,679,438 | B1 * | 1/2004 | Didlo | B05B 1/28 239/288.5 |
| 7,377,710 | B2 | 5/2008 | Baumann | |
| D610,227 | S | 2/2010 | Hunter | |
| 8,814,007 | B2 * | 8/2014 | Mills | B05B 11/0089 222/321.7 |
| 9,511,381 | B2 | 12/2016 | Takahashi | |
| 9,827,577 | B2 | 11/2017 | Kuwahara | |
| 2004/0086321 | A1 | 5/2004 | Burkholz et al. | |
| 2008/0264974 | A1 * | 10/2008 | Binderbauer | B05B 11/007 222/321.3 |
| 2009/0166382 | A1 | 7/2009 | Snodgrass | |
| 2009/0173751 | A1 | 7/2009 | Laidler | |
| 2010/0127018 | A1 | 5/2010 | Laidler | |
| 2012/0091229 | A1 | 4/2012 | Laidler | |
| 2012/0187152 | A1 | 7/2012 | Zhou et al. | |
| 2012/0234947 | A1 | 9/2012 | Takahashi | |
| 2012/0273525 | A1 | 11/2012 | Canfield | |
| 2013/0037575 | A1 | 2/2013 | van der Molen | |
| 2013/0098943 | A1 | 4/2013 | Sciole | |
| 2014/0034679 | A1 * | 2/2014 | Fitzpatrick | A47K 5/14 222/190 |
| 2014/0367480 | A1 | 12/2014 | Tonh | |
| 2015/0273486 | A1 | 10/2015 | Kuwahara | |
| 2018/0297040 | A1 | 10/2018 | Hirata | |

FOREIGN PATENT DOCUMENTS

| | | | |
|---|---|---|---|
| CN | 203209211 | U | 9/2013 |
| DE | 36 15 741 | A1 | 11/1987 |
| EP | 002862243-0001 | | 11/2015 |
| EP | 002862243-0002 | | 11/2015 |
| EP | 002862953-0001 | | 11/2015 |
| EP | 002862953-0002 | | 11/2015 |
| JP | S53-051848 | U | 5/1978 |
| JP | 61-54248 | A | 3/1986 |
| JP | H04-080880 | U | 7/1992 |
| JP | 6-3886 | U | 1/1994 |
| JP | 7-28056 | U | 5/1995 |
| JP | 2000-185782 | A | 7/2000 |
| JP | 2001-334178 | A | 12/2001 |
| JP | 2008-36531 | A | 2/2008 |
| JP | 2010-26033 | A | 2/2010 |
| JP | 2010-105694 | A | 5/2010 |
| JP | 3159292 | U | 5/2010 |
| JP | 1390113 | | 6/2010 |
| JP | 2010-149060 | A | 7/2010 |
| JP | 1399832 | | 10/2010 |
| JP | 2010-269233 | A | 12/2010 |
| JP | 2011-184088 | A | 9/2011 |
| JP | 2012-202207 | A | 10/2012 |
| JP | 2012-532644 | A | 12/2012 |
| JP | 1399833 | | 10/2013 |
| JP | 1399834 | | 10/2013 |
| JP | 5412106 | B2 | 2/2014 |
| JP | 1545214 | S | 3/2016 |
| JP | 1545215 | S | 3/2016 |
| JP | 1548678 | S | 5/2016 |
| JP | 1548679 | S | 5/2016 |
| JP | 2016-209867 | A | 12/2016 |
| JP | 2017-7706 | | 1/2017 |
| JP | 2017-12971 | A | 1/2017 |
| JP | 2017-12972 | A | 1/2017 |
| JP | 2017-14375 | A | 1/2017 |
| JP | 2018-200393 | A | 12/2018 |
| WO | WO2011/138828 | A1 | 11/2011 |
| WO | WO 2014/068627 | A1 | 5/2014 |

OTHER PUBLICATIONS

Office Action dated Apr. 16, 2019 in Japanese Patent Application No. 2017-180013, with concise English translation.

Combined Office Action and Search Report dated Nov. 5, 2018 in Chinese Patent Application No. 201580063581.6, 16 pages (with unedited computer generated English translation and English translation of categories of cited documents).

Extended European Search Report dated Sep. 13, 2018 in Patent Application No. 15863617.5, 8 pages.

Combined Chinese Office Action and Search Report dated Feb. 24, 2018 Chinese Patent Application No. 201580063581.6 (with English translation), 20 pages.

Office Action dated Aug. 1, 2017 in Japanese Patent Application No. 2015-115150 (with unedited computer generated English translation).

International Search Report dated Feb. 23, 2016 in PCT/JP2015/083474 filed Nov. 27, 2015.

* cited by examiner

FOAM DISPENSING CONTAINER

CROSS-REFERENCE TO RELATED APPLICATIONS

This application is continuation of U.S. application Ser. No. 15/531,288 filed May 26, 2017, which is a National Stage entry under 35 U.S.C. § 371 of PCT/JP2015/083474, filed on Nov. 27, 2015, and claims priority to Japanese Patent Application No. 2014-241538, filed on Nov. 28, 2014, Japanese Patent Application No. 2015-115150, filed on Jun. 5, 2015, and Japanese Patent Application No. 2015-130405, filed on Jun. 29, 2015. The entire content and disclosure of each of the foregoing applications is incorporated herein by reference.

TECHNICAL FIELD

This invention relates to a foam dispensing container that dispenses a liquid agent into foam, and a foam dispenser attachment used for the foam dispensing container.

BACKGROUND ART

There has been proposed a container (foam dispensing container) designed to dispense, from a container body, a various types of liquid materials (liquid agents) including hand soap, face wash, dishwashing detergent, hairdressing agent into foam after mixing them with air. For example, Patent Literature 1 describes a container with a foaming pump, designed to dispense a liquid agent housed in the container body into foam, when a nozzle head is pressed down. The container has a foam dispensing adapter having discretely arranged thereon a plurality of circular outlets according to a triangular or pentagonal layout at the vertexes and the center. The foam dispensing adapter is detachably attached to the nozzle head so as to be capped thereon from the top. In the container, positions and diameter of the outlets are determined so as to build up a foam object modeled after a character, as a result of crowding of foam lumps dispensed through a plurality of outlets.

Patent Literature 2 describes an aerosol container that jets, from a container body containing a liquid agent and a pressurizing gas, such liquid agent into a foamy or gel-like matter. By pressing the nozzle head down, the outlet is opened, and the liquid agent having been filled under pressure is jetted powerfully to produce foam or gel, to build up a spaghetti- or band-like contiguous geometry. The nozzle head has formed therethrough a plurality of flow channels through which the liquid agent is dispensed, and the outlet corresponds to each of these flow channels. Patent Literature 2 proposes various types of the outlet. More specifically, a plurality of outlets shaped like slit, rectangle, circle, star and so forth are discretely arranged over the face of the nozzle head. With such design, plural lines of foam or gel with a contiguous geometry will be dispensed.

The containers described in Patent Literature 1 and Patent Literature 2 were designed to dispense the foamy liquid agent through the outlets with the aid of the mechanical foaming pump or pressurizing gas, when the user presses down the nozzle head. Meanwhile, Patent Literature 3 describes a device that dispenses a liquid agent into foam, with the aid of an electrically actuated pump. The pump has an electrically reciprocated piston, which is activated upon detection of approach of the user's hand by a sensor, and quantitatively dispenses a predetermined amount of liquid agent. The liquid agent is dispensed through a round open nozzle in the form of liquid or foam.

CITATION LIST

Patent Literature

[Patent Literature 1] JP-A-2010-149060
[Patent Literature 2] U.S. Pat. No. 5,813,785
[Patent Literature 3] JP-T2-2012-532644
[Patent Literature 4] JP-A-2008-36531
[Patent Literature 5] JP-Y2-H07-28056

SUMMARY OF THE INVENTION

Technical Problem

By dispensing the liquid agent in a foamy manner, the user can quickly use it for cleansing or the like, without need of foaming it by hands. The container of Patent Literature 1 can build up the dispensed foam modeled after characters, posing an advantage of being joyful to see, not only for the convenience of cleansing.

The container of Patent Literature 1 can, however, only build the foam object with a relatively simple shape based on combination of several spherical lumps of foam, since the container merely has the circular outlets at a plural points. It is therefore difficult for the container of Patent Literature 1 to build up a finely-profiled foam object with the intended shape in various ways.

The container of Patent Literature 2 is an aerosol container for jetting foamy or gel-type liquid agent through a plurality of outlets to build up the spaghetti-like or band-like contiguous geometry, and the liquid agent having been filled under pressure is jetted powerfully in the form of foam or gel. It is therefore difficult for the container of Patent Literature 2 to build up a foam object with the intended shape modeled after characters of so, unlike the container of Patent Literature 1.

There is therefore a need for building up the liquid agent dispensed into foam with finely-profiled intended shape.

Solution to Problem

This invention is to provide a foam dispensing container that includes a container body that reserves a liquid agent; a head part that has an outlet, and dispenses the liquid agent delivered from the container body through the outlet into foam; and a dispensing operation part that allows dispensing of a predetermined amount of the foamy liquid agent through the outlet each time it accepts a user's operation, the outlet being an opening with a contiguous geometry narrowed from an intended shape, and being designed to build up the foamy liquid agent, dispensed through the outlet as a result of a single or multiple operations made on the dispensing operation part, into the intended shape in a plan view seen in the dispensing direction.

This invention is also to provide a foam dispenser attachment used while attached detachably to a nozzle part of a foam dispensing container that includes a container body that reserves a liquid agent; a nozzle part that has a nozzle opening, and dispenses the liquid agent delivered from the container body through the nozzle opening into foam; and a dispensing operation part that allows dispensing of a predetermined amount of the foamy liquid agent through the nozzle opening each time it accepts a user's operation, the foam dispenser attachment having an outlet with a contiguous geometry narrowed from an intended shape, and being designed to accept the foamy liquid agent dispensed through the nozzle opening and to dispense it through the outlet to thereby build up a foam object with the intended shape.

Advantageous Effects of Invention

According to the foam dispensing container, and the foam dispenser attachment used for such foam dispensing container of this invention, the outlet is opened to have a contiguous geometry narrowed from the intended shape, so that the dispensed foam swells in the width direction to be built up to such intended shape in a plan view. This invention can therefore build up the foam object with the intended shape in a finely profiled manner.

BRIEF DESCRIPTION OF DRAWINGS

The above and other objects, features and advantages of this invention will be more apparent from the following description of certain preferred embodiments taken in conjunction with the accompanying drawings.

DESCRIPTION OF EMBODIMENTS

Embodiments of this invention will be explained below referring to the attached drawings. In all drawings, all similar constituents will be given the same reference signs to properly skip repetitive explanation.

First Embodiment

Figure 1:
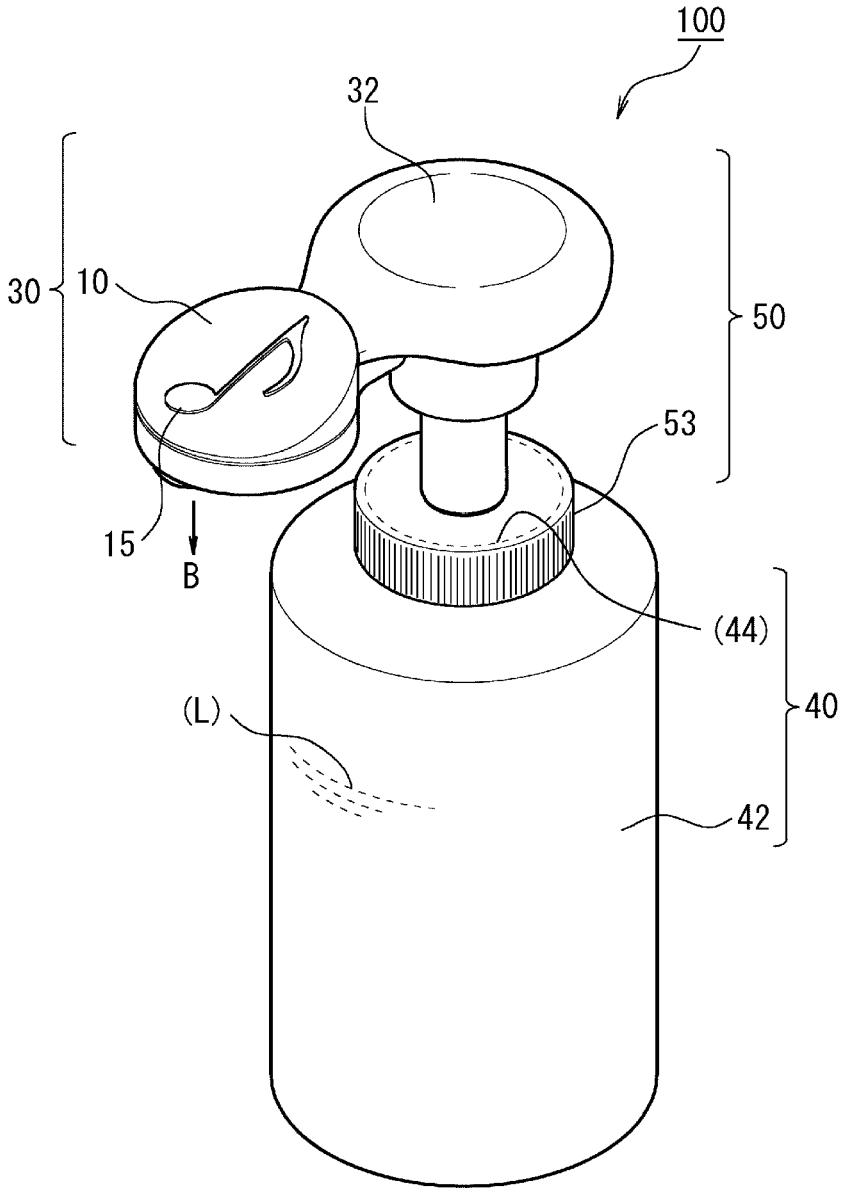
FIG. 1 is a top perspective view illustrating a foam dispensing container of a first embodiment.
Figure 2:
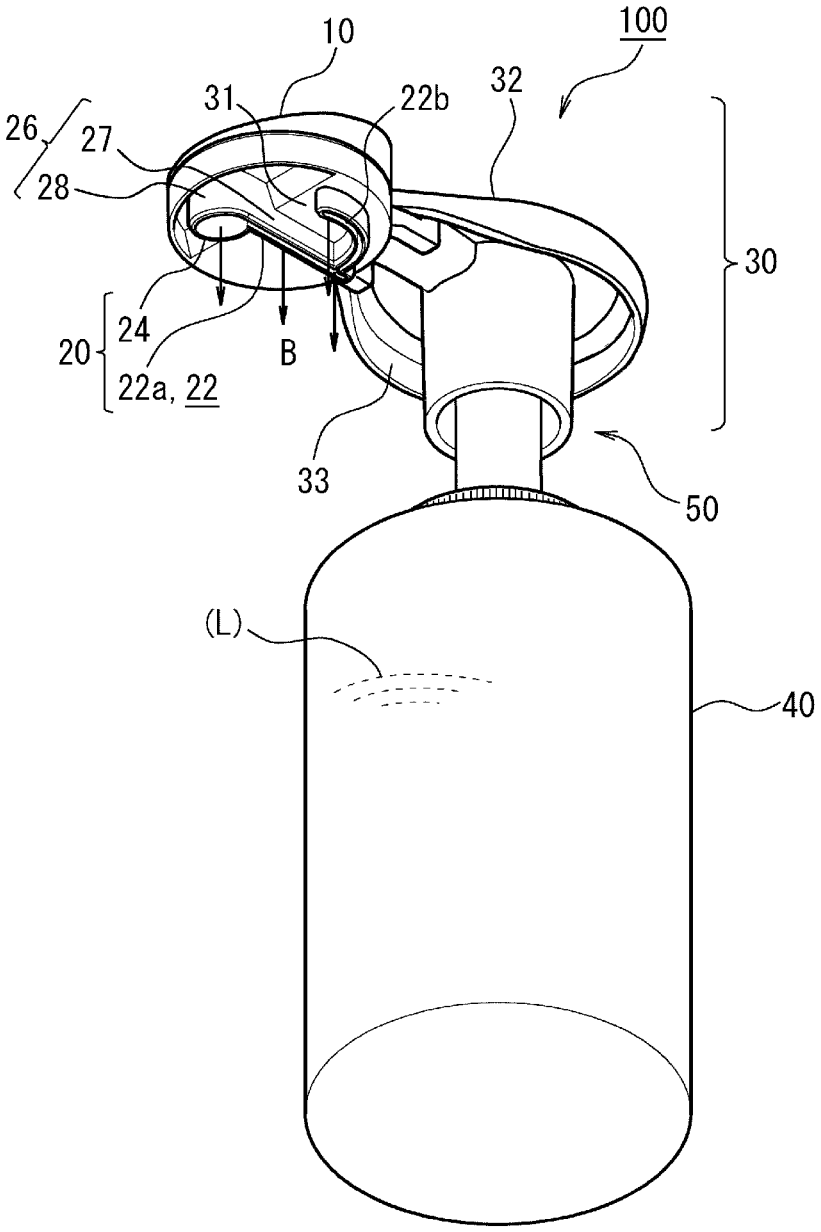
FIG. 2 is a bottom perspective view illustrating the foam dispensing container.
Figure 3A:
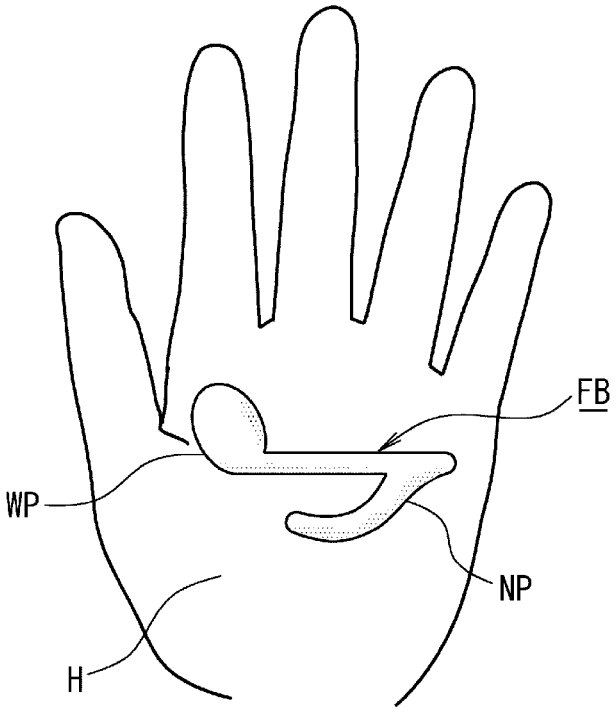
FIG. 3A is a plan view illustrating a dispensed foam object.
Figure 3B:
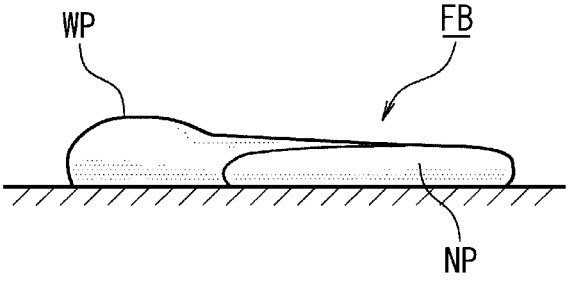
FIG. 3B is a front elevation of the foam object.

FIG. 1 is a top perspective view illustrating a foam dispensing container 100 according to a first embodiment of this invention, and FIG. 2 is a bottom perspective view of the foam dispensing container 100. FIG. 3A is a plan view illustrating a foam object FB dispensed out from the foam dispensing container 100 of this embodiment, and FIG. 3B is a front elevation of the foam object FB.

The foam dispensing container 100 of this embodiment has a container body 40 that reserves a liquid agent L, a head part 30 having an outlet 20, and a dispensing operation part (pump head part 32). The head part 30 dispenses the liquid agent L delivered from the container body 40 through the outlet 20 into foam. The dispensing operation part (pump head part 32) allows dispensing of a predetermined amount of foamy liquid agent (foam B) through the outlet 20, each time it accepts a user's operation. In this way, the foam object FB with a desired intended shape as illustrated in FIG. 3A is built.

The outlet 20 of this embodiment is formed to have such contiguous geometry narrowed from the intended shape. The foamy liquid agent (foam B) dispensed through the outlet 20, as a result of a single or multiple operations made on the dispensing operation part (pump head part 32), is built up into an intended shape in a plan view seen in the dispensing direction.

The foam dispensing container 100 will be further detailed below. In this specification, with the container body 40 stood upright, the side the head part 30 positioned relative to the container body 40 will be denoted as "top" or "upper side", and the opposite side will be denoted as "bottom" or "lower side". Such vertical direction does not always necessarily agree with the perpendicular direction. For the convenience, among horizontal directions that cross normally to the top-bottom direction, the direction connecting the container body 40 and the outlet 20 will occasionally be referred to as "distal-proximal direction", and the side of the container body 40 closer to the outlet 20 referred to as "distal side".

The foam dispensing container 100 is a container capable of dispensing the liquid agent L, reserved in a liquid form in the container body 40, after transforming it into foamy article. Although the liquid agent L is now represented by a hand soap, it may also be exemplified, without being limited thereto, by various products used in a foamy form, including face-wash, cleanser, dishwashing detergent, hairdressing, body soap, shaving cream, skin cosmetics such as foundation, hair dyes, and foods such as whipped cream.

The foam dispensing container 100 is a container capable of dispensing the liquid agent L from the container body 40, upon being actuated mechanically or electrically. When roughly itemized, the foam dispensing container 100 is composed of the container body 40 that reserves the liquid agent L, and a nozzle assembly 50 (foam delivery mechanism 50) that is attached to the container body 40 and is used for dispensing the liquid agent L.

The liquid agent L is reserved in the container body 40 at normal pressure or under pressure. The foam dispensing container 100 transforms the liquid agent L into foam, by bringing the liquid agent L reserved at normal pressure into contact with air, or reducing the pressure around the liquid agent L reserved under pressure. In this specification, the foamy liquid agent L will occasionally be referred to as "foam B", for the convenience of discriminating it from the non-foamy liquid agent L reserved in the container body 40.

The foam dispensing container 100 of this embodiment is, as described later, a mechanical pumping container by which the liquid agent L reserved in the container body 40 at normal pressure is sucked up through a suction tube 57, when a piston 55 (see FIG. 4) is driven by a press-down operation made on the pump head part 32.

The container body 40 has a bottle form, and has a hollow trunk 42, and a bottleneck 44 formed on the top end of the trunk 42 so as to shrink the diameter. Geometry and inner volume of the container body 40 are not specifically limited. The container body 40 is made of a synthetic resin. Now the liquid agent L (foam B) may be dispensed, alternatively to this embodiment, typically with the aid of a pressurized gas contained in a bomb, such as aerosol product, or with the aid of an electrically actuated motor 98 (see FIG. 15 and FIG. 28), so long as a predetermined amount of foam B can be dispensed each time the user's operation is accepted.

The outlet 20 is an opening through which the form B is dispensed outside the foam dispensing container 100. The head part 30 is a term collectively denoting portions that form a flow channel of the liquid agent L or foam B outside the container body 40, and encompasses the outlet 20.

The outlet 20 is formed so as to be opened downward in a bottom face 31 of the head part 30, specifically at a portion thereof projected laterally from the bottleneck 44 of the container body 40. The dispensing direction of the foam B dispensed through the outlet 20 is downward, and downward visual viewing will be referred to as "plan view". The foam B, when dispensed through the outlet 20 and released to the atmospheric pressure, will be locally swelled in the individual portions, while keeping as a whole the geometry of the outlet 20. In this way, the foam B will be built up into the foam object with an intended shape FB on the user's palm H (see FIG. 3A) or on various application tools such as sponge or brush.

The head part 30 of this embodiment has a dispensing guide 26 having the outlet 20 on the bottom end thereof. The dispensing guide 26 is provided so as to extend below the head part 30 (more specifically a reservoir 60, see FIG. 6), and has a straight pipe-like throughhole that is formed in the same geometry with the outlet 20. The dispensing guide 26 in this embodiment is provided so as to suspend down from the head part 30 and is formed like a wall that surrounds the outlet 20.

The form B dispensed through the head part 30 is rectified as a whole after allowed to pass through the dispensing guide 26. In this way, the dispensed foam B is prevented from swelling in the widthwise direction, and thereby the foam object FB is suitably formed into the predetermined intended shape.

The dispensing guide 26 in this embodiment is formed so as to suspend down from the head part 30 and is formed like a wall. This beneficially prevents the dispensed foam B from adhering onto the undersurface of the head part 30, making it possible to improve release of the foam B, and to build up a well-profiled foam object FB. This invention is, however, not limited thereto, and wherein the dispensing guide 26 may be formed so as to be buried in the wall of the bottom face 31 of the head part 30. A possible case where the dispensing guide 26 is buried in the wall of the bottom face 31, may be such that the bottom face 31 is made thick enough, and a through-hole formed so as to extend through the bottom face 31 may be used as the dispensing guide 26. In this case, from the viewpoint of improving release of the foam B dispensed through the dispensing guide 26 formed so as to extend through the bottom face 31, it is possible to carve bottom face 31 (that is, the undersurface of the head part 30) to form a trench-like recess with a predetermined depth around the dispensing guide 26. By forming the recess close to the dispensing guide 26, the dispensing guide 26 will eventually be surrounded by a thin wall, and can thereby reduce the amount of foam B probably adhere onto the bottom face 31 of the head part 30.

Width (aperture) and geometry of the outlet 20 are determined so that the foam object FB with intended shape may be built up, when the foam B was dispensed onto the dispensing target plane TP positioned a predetermined distance SP (see FIG. 21) below the level of the outlet 20 upon completion of dispensing of the foam B. The level of the outlet 20 upon completion of dispensing of the foam B is a level of the outlet 20 when the pump head part 32 was pressed down to reach the lower limit position.

The intended shape of the foam object FB may be any of planar icons (pictures) representing letters, graphics and symbols. That is, the phrase stating that "the foamy liquid agent (foam B) is built up into an intended shape in a plan view seen in the dispensing direction, as a result of operation made on the dispensing operation part" means that the foam object FB, having a shape of a predetermined form in a plan view in the dispensed direction, is built on the dispensing target plane TP positioned a predetermined distance SP below the level of the outlet 20 upon completion of dispensing of the foam B. The foam object FB is formed into a three-dimensional shape having a predetermined thickness, on the dispensing target plane TP such as palm H. Such three-dimensional shape is recognized to be the above-described intended shape in a plan view in the dispensing direction.

Graphics of the intended shape is exemplified by those of animal, plant, human, animation character, geometrical shape, and pattern.

As illustrated in FIG. 1, the head part 30 has embossed on the top face thereof a pattern indication 15 that corresponds to the intended shape of the foam object FG (see FIG. 3A) built up with the dispensed foam B seen in a plan view. In this embodiment, a musical note symbol (eighth note) is illustrated as an example of the intended shape of the foam object FB. The user can easily discriminate, at a glance, a plurality of types of the foam dispensing containers 100 whose geometries of the outlets 20 are different.

The outlet 20 of this embodiment is formed as an opening having a contiguous geometry narrowed from the intended shape that is a plan view of the foam object FB. Now the phrase stating that the "intended shape is narrowed" means that the widths of the individual portions composing the intended shape are shrunk along the contour of the intended shape, or are shrunk so as to fill up the inside of the intended shape. The phrase stating that the "outlet 20 has a contiguous geometry" means that at least a partial area of the outlet 20 has a linear form whose length is sufficiently larger than the width. Representatively, the linear form is preferably a contiguous long shape, but the linear form is not limited thereto, and also includes embodiments having a plurality of discrete elements (openings) closely juxtaposed in the longitudinal direction, which are exemplified by the forms of broken line and chain line. More specifically, unlike the container of Patent Literature 1 by which an intended shape is stippled by using a plurality of outlets distributed two-dimensionally, the outlet 20 of this embodiment draws at least a part of the intended shape like a line drawing, by aid of the contiguous geometry that contains a long linear portion. Such linear portion may be a contiguous opening, or may be discrete openings arranged in line. In the description below, the term "linear" will be used to encompass a mode representing a continuous line, and a mode representing discrete elements arranged in line to give a broken line, chain line and so forth. The phrase stating that "the outlet 20 has a contiguous geometry narrowed from the intended shape" means that linear portions of the outlet 20 are arranged along the contour of the intended shape, or so as to fill the inside of the intended shape, for the purpose of building up the intended shape using the foam B that swells after dispensed.

For the purpose of building up, with the foam B, a lump of intended shape which outlines the plan view geometry of the foam object FB, the outlet 20 may be given as an opening with an integrated contiguous geometry. Alternatively, each of a plurality of partial outlets has a contiguous geometry, and these partial outlet may be combined to give the outlet 20. Each of the outlets 20 according to this embodiment and the later-described first to third modified examples (see FIG. 11A to FIG. 13A) is integrally formed. Meanwhile the outlet 20 according to the fourth modified example (see FIG. 14A) is configured by combining narrowly-opened parts 22*a*, 22*b* which correspond to the partial outlet.

By forming the outlet 20 with a contiguous geometry as seen in the foam dispensing container 100 of this embodiment, the outlet 20, even if partially clogged, can sustainably dispense the foam B from both sides of the clogged portion. This is beneficial to avoid dispensing failure of the foam B, due to total clogging of the outlet 20. A possible cause of clogging of the outlet 20 is such that a residue of the foam B in the head part 30 may return after elapse of a certain period of time into the liquid agent L in liquid form, and can further promote solidification. However, by making the outlet 20 with a contiguous geometry, is now possible to prevent the total clogging of the outlet 20, even if a long duration of time elapsed after the foam B was dispensed and before the next dispensing operation, and the outlet 20 should be partially clogged. In other words, even if the liquid agent L contains an ingredient that is likely to solidify, it now becomes possible to dispense the foam B while reducing a risk of clogging of the outlet 20. By dispensing the foam B through opening portions adjoining to the locally clogged portion of the outlet 20, the solidified moiety that caused clogging may be expelled from the outlet 20 in such a way entrained by the dispensed foam B. In particular, as a result of contiguousness of formation of the narrowly-opened part 22 and the widely-opened part 24 as seen in this embodiment, even if the narrowly-opened part 22 should be partially clogged, the clogging at the narrowly-opened part 22 may be resolved by dispensing the form B through the widely-opened part 24. From this point of view, the outlet 20 preferably has a pair of widely-opened parts 24 (24*a*, 24*b*) on both ends of the narrowly-opened part 22 (see FIG. 11A).

The foam dispensing container 100 dispenses a predetermined amount of foam B through the outlet 20 each time the dispensing operation part (pump head part 32) is operated. Now the phrase stating that "a predetermined amount of foam B is dispensed" conceptually exclude that "foam B is unlimitedly and continuously dispensed", so that the amount of foam B dispensed through the outlet 20 per operation made on the dispensing operation part (pump head part 32) is not always necessarily constant in a strict sense. "A predetermined amount of foam B dispensed through the outlet 20" means a bulk volume of foam B delivered through the outlet 20, when the dispensing operation part (pump head part 32) is operated, with the flow channel inside a nozzle assembly 50 (see FIG. 4) including the head part 30 preliminarily filled with the foam B to the full. Such predetermined amount is the amount preliminarily and roughly given by conditions including the structure of the nozzle assembly (foam delivery mechanism) 50 and characteristics of the liquid agent L.

The bulk volume of the foam B dispensed per operation is preferably such as fitting in adult's palm H as illustrated in FIG. 3A, and may typically be 1 $cm^3$ or more and 20 $cm^3$ or less. The amount of dispensed foam B per operation of the foam dispensing container 100 of this embodiment is determined based on parameters including stroke in reciprocating motion of a piston 55 (see FIG. 4) described later.

By dispensing a predetermined amount of foam B as a result of operation made on the dispensing operation part (pump head part 32) as demonstrated by the foam dispensing container 100 of this embodiment, the foam object FB is prevented from unlimitedly swelling, and thereby a desired foam object FB with intended shape may be built up. A specific geometry of opening of the outlet 20, in particular the degree of narrowing from the intended shape, is determined so that the desired foam object FB with intended shape will be build up with a total amount of foam B dispensed by repetitively operating the dispensing operation part (pump head part 32) a predetermined certain number of times (one or plural times).

The geometry of the outlet 20 will further be detailed.

As illustrated in FIG. 2, the outlet 20 of this embodiment has a linear narrowly-opened part 22 and a widely-opened part 24 made wider than the narrowly-opened part 22. The widely-opened part 24 is formed contiguously with the narrowly-opened part 22. The outlet 20 is formed to have a contiguous geometry participated by the narrowly-opened part 22 and the widely-opened part 24.

The linear narrowly-opened part 22 may be a contiguous long opening as described above, or may be discrete openings arranged in line. The narrowly-opened part 22 may have a form of constant-width band, or may have a width that varies in the longitudinal direction.

Extension style of the narrowly-opened part 22 may be straight, curved, or bent, without special limitation. The narrowly-opened part 22 in this embodiment is composed of a plurality of narrowly-opened parts 22*a*, 22*b* which are bent and mutually connected. As described later, the narrowly-opened part 22*a* has a straight form, meanwhile the narrowly-opened part 22*b* has a curved form.

The widely-opened part 24 is an opened region of the outlet 20, made wider than the width of opening of the linear narrowly-opened part 22. Being bounded by a boundary where the width of opening of the outlet 20 discontinuously or abruptly increases, the side with a smaller width of opening will be denoted as the narrowly-opened part 22, and the wider side will be denoted as the widely-opened part 24.

The widely-opened part 24 may have a line pattern wider than the narrowly-opened part 22, or may be polygonal or near-circular form, without special limitation. As illustrated in FIG. 2, the widely-opened part 24 in this embodiment has a near-circular form with a diameter larger than the width of the narrowly-opened part 22 (22*a*, 22*b*).

As illustrated in FIG. 3A, the foam object FB dispensed through the outlet 20 has a wide foam portion WP that corresponds to the widely-opened part 24 and a narrow portion NP that corresponds to the narrowly-opened part 22. The foam object FB built up by the foam dispensing container 100 of this embodiment has, as schematically illustrated in FIG. 3B, nearly equal height for the wide foam portion WP and the narrow portion NP. More specifically, as for the container of Patent Literature 1, by which the foam object is composed of discretely dispensed round foams swollen in all directions and crowded each other, it has been necessary to make the volume of each dispensed round foam sufficiently large. In contrast in this embodiment, since the outlet 20 is formed with the contiguous geometry, so that the dispensed foam B swells on the palm H which is the dispensing target plane, solely in the width direction of the outlet 20, and builds up the foam object FB substantially without expansion in the longitudinal direction. Accordingly, a desired foam object FB with intended shape may be built up only with a small amount of foam B. Owing to the suppressed difference of height within the foam object FB, such desired intended shape will be well-profiled in a plan view.

Figure 4:
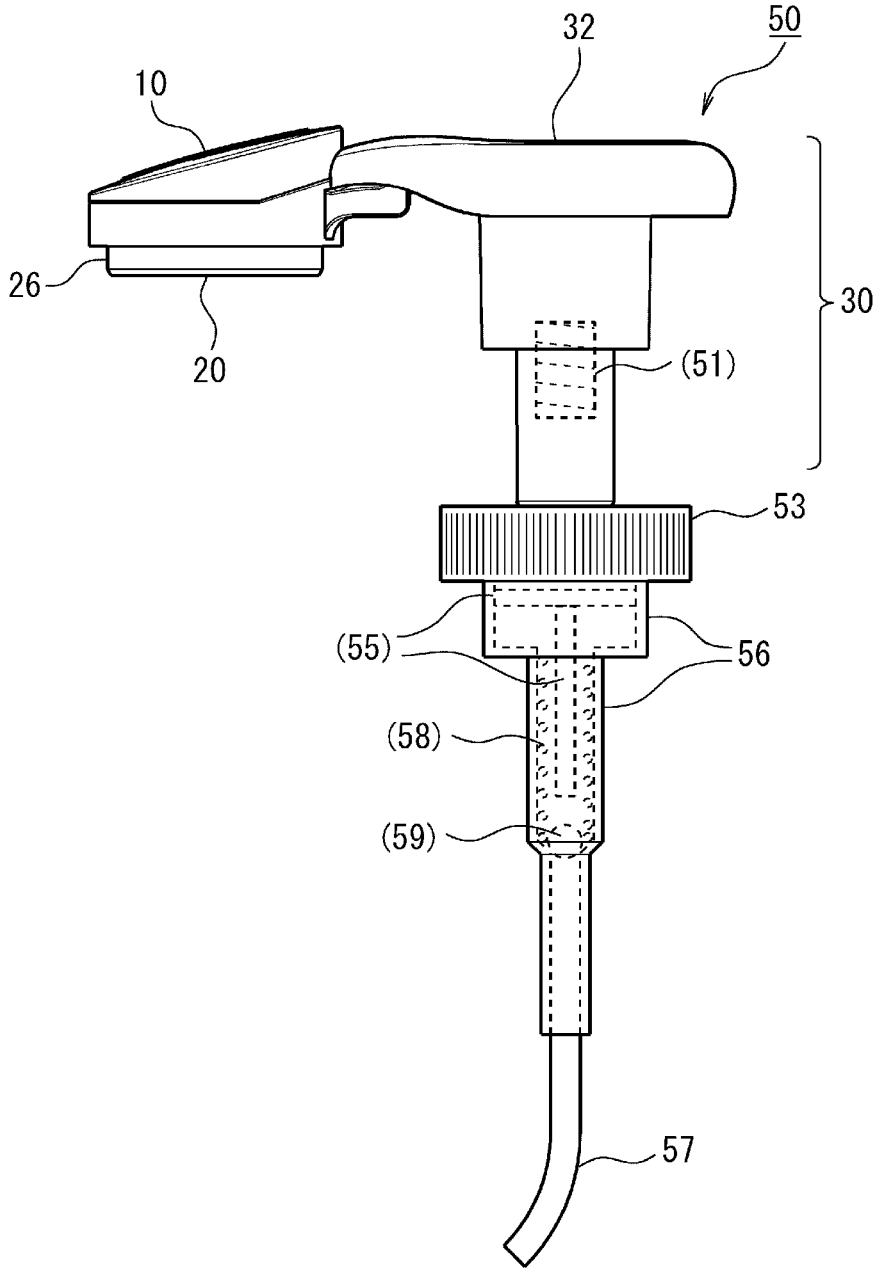
FIG. 4 is a side elevation of a nozzle assembly (foam delivery mechanism) including a head part.
Figure 5:
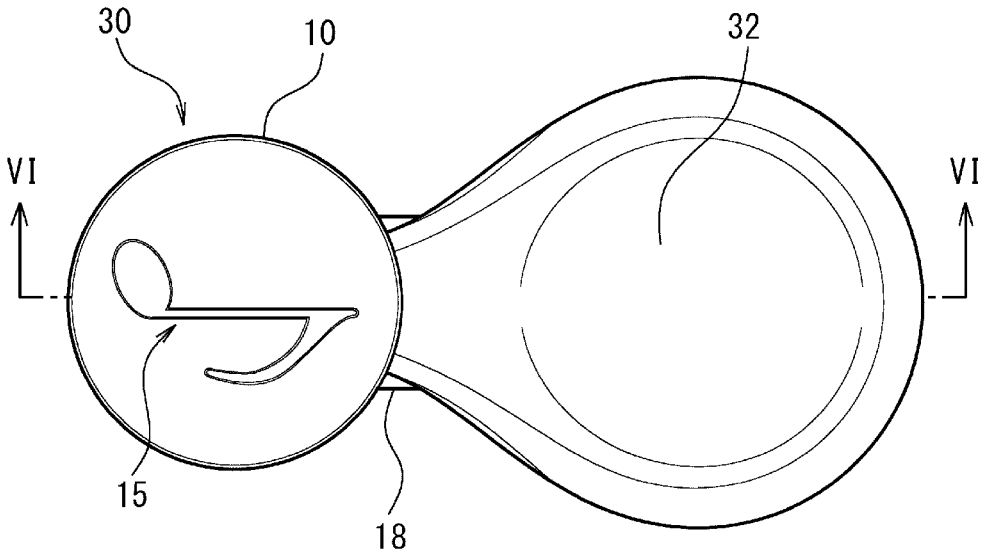
FIG. 5 is a plan view illustrating a head part.
Figure 6:
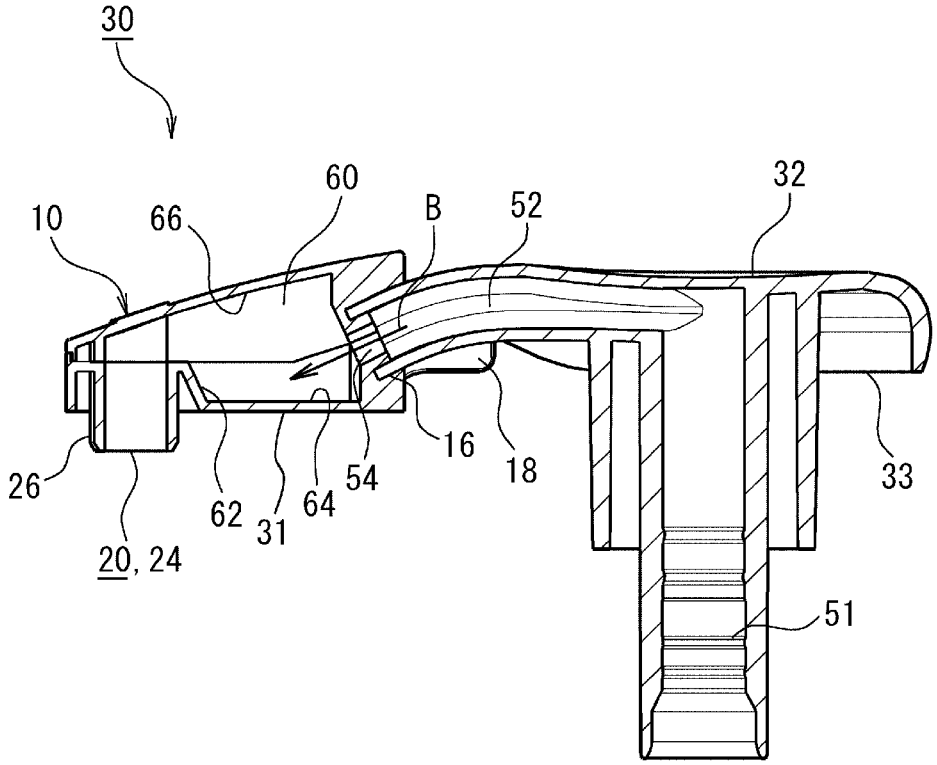
FIG. 6 is a cross-sectional view taken along line VI-VI in FIG. 5.
Figure 7:
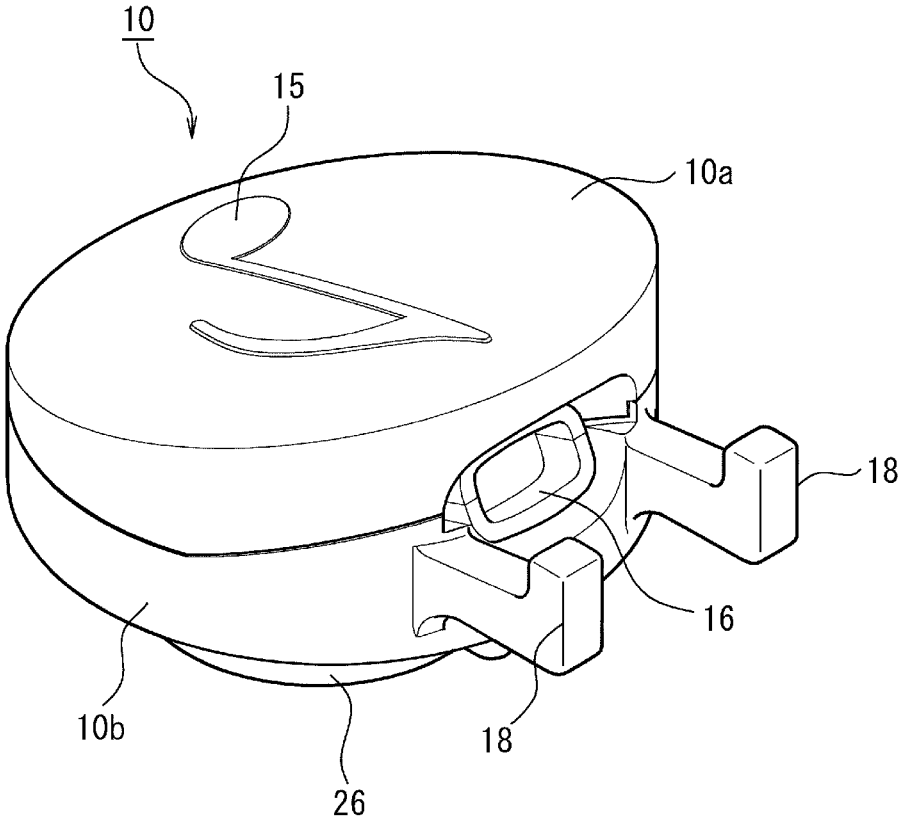
FIG. 7 is a perspective view illustrating a foam dispenser attachment of the first embodiment.

FIG. 4 is a side elevation of the nozzle assembly 50 including the head part 30. FIG. 5 is a plan view of the head part 30. FIG. 6 is a cross-sectional view taken along line VI-VI in FIG. 5, showing a sectional side elevation of the head part 30. FIG. 7 is a perspective view of a foam dispenser attachment 10.

As illustrated in FIG. 4, the nozzle assembly 50 has, besides the above-described head part 30, a cap 53, a housing 56, a suction tube 57, and an air-liquid contact portion 51 described later. The housing 56 houses a piston 55, a spring 58 and a ball valve 59, and is placed inside the container body 40 (see FIG. 1). The suction tube 57 is provided so as to communicate with the lower part of the housing 56, being aimed to suck up the liquid agent L. The cap 53 is detachably attached to the bottleneck 44 of the container body 40 while placing the housing 56 and suction tube 57 in the container body 40 (see FIG. 1), to thereby fix the nozzle assembly 50.

More specifically, the foam dispensing container 100 of this embodiment further includes a piston 55 that is attached to the container body 40 by aid of the cap 53 and is movable reciprocatively relative to the cap 53; and the housing 56 that houses the piston 55 and communicates with the outlet 20. The dispensing operation part (pump head part 32) in this embodiment sucks the liquid agent L from the container body 40 up into the housing 56 and dispenses it through the head part 30, by moving the piston 55 reciprocatively upon acceptance of a user's press-down operation.

The structure and operation of the nozzle assembly 50 will be briefed below. The ball valve 59 is a valve that prevents fall of the liquid agent L having been reserved in the housing 56 and the suction tube 57. When the user presses down, by his or her hand or so, the pump head part 32 (dispensing operation part) of the head part 30, the piston 55 increases air pressure in the housing 56, while restricting the ball valve 59 from ascending (opened) with the lower end of the piston 55. The piston 55 has provided thereto a liquid flow channel (not illustrated), which is a small hole that communicates the housing 56 with the head part 30. Since the area of opening of the liquid flow channel is sufficiently small, the air pressure in the housing may be elevated by pressing the pump head part 32 down powerfully, and the liquid agent L is then pushed from the housing 56 up into the head part 30. The head part 30 has provided thereto an air flow channel (not illustrated) that is communicated with the outside. The head part 30 has provided therein an air-liquid contact portion 51 on the flow channel for the liquid agent L. The air-liquid contact portion 51 is typically a mesh, which transforms the liquid agent L into foam (foam B), by allowing the air outside the head part 30 and the air in the housing 56, together with the liquid agent L, to pass through the air-liquid contact portion 51 (mesh). The foam B is dispensed through the outlet 20 of the head part 30. When the user releases his or her hand or so from the pump head part 32, the spring 58 elastically returns the piston 55 to the original position. The pressure inside the housing 56 becomes low, the ball valve 59 is opened, and a new portion of the liquid agent L is sucked up into the suction tube 57 to fill the housing 56 again. The inside of the head part 30 is kept at the atmospheric pressure with the outer air introduced through the air flow channel into the head part 30.

The above-described structure and operation of the nozzle assembly 50 are merely examples, and also well-known ones, such as a foam dispenser described in Patent Literature 4 described above, may be used.

With the nozzle assembly 50 of this embodiment, a predetermined amount of foam B is dispensed through the outlet 20, each time the pump head part 32 (dispensing operation part) is operated. The predetermined amount is determined by parameters such as stroke in reciprocating motion of the piston 55.

As illustrated in FIG. 4 to FIG. 6, the head part 30 of this embodiment is configured to combine a nozzle part 52 and the foam dispenser attachment 10. The nozzle part 52 has a nozzle opening 54 through which the foamy liquid agent (foam B) from the container body 40 is delivered. The nozzle part 52 is provided above the air-liquid contact portion 51 so as to communicate with the housing 56, and allows the liquid agent L after transformed into foam to flow therethrough. The nozzle part 52 of this embodiment is integrally formed inside the pump head part 32.

The foam dispenser attachment 10 is used while being detachably attached to the nozzle part 52 of the foam dispensing container 100. The foam dispenser attachment 10 has the outlet 20, and when detachably attached to the nozzle part 52, the outlet 20 communicates with the nozzle opening 54. More specifically, the foam dispenser attachment 10 of this embodiment has the outlet 20 with the contiguous geometry narrowed from the intended shape, catches the foamy liquid agent (foam B) dispensed from the nozzle opening 54, and dispenses it through the outlet 20 to build up the foam object FB with intended shape.

With such design of the head part 30 separable into the foam dispenser attachment 10 and the nozzle part 52, a plurality of types of foam dispenser attachments 10 having different opening geometries of the outlet 20 may be attached to the nozzle part 52 in an exchangeable manner. The foam object FB with intended shape may be built up by dispensing, while using the container body 40 and the nozzle assembly 50 in common. Conversely, the common foam dispenser attachment 10 may be attached to the nozzle assemblies 50 of different container bodies 40 in an exchangeable manner. Accordingly, if the container body 40 and the nozzle assembly 50 should be discarded or exchanged, the foam dispenser attachment 10 may be used consecutively, and the foam dispenser attachment 10 may be attached afterward to the container body 40 and the nozzle assembly 50 having widely been put into practical use.

As illustrated in FIG. 6 and FIG. 7, the foam dispenser attachment 10 has a fitting part 16 to which the nozzle opening 54 is inserted, and an engagement part 18 that detachably engages with the nozzle part 52. The fitting part 16 of the foam dispenser attachment 10 is an opening with a geometry corresponded to the outer profile of the nozzle part 52 of the nozzle assembly 50, and allows the nozzle part 52 to be tightly fitted thereto. Although geometry of the engagement part 18 is not specifically limited, the engagement part 18 in this embodiment is a claw-like projection that projects upward, and is provided in a pair on both sides of the fitting part 16. As illustrated in FIG. 2, the pump head part 32 in this embodiment has an umbrella-like shape, and the circumference 33 of the pump head part 32 suspends downward. The engagement part 18 of the foam dispenser attachment 10 engages with the circumference 33 of the pump head part 32, particularly on both sides of the nozzle part 52. In this way, the foam dispenser attachment 10 attached to the pump head part 32 may be prevented from inclining in the front-rear direction and in the crosswise direction relative to the pump head part 32. The foam dispenser attachment 10 is therefore unlikely to contingently incline or detach, even if the foam B is jetted powerfully through the nozzle part 52 into the foam dispenser attachment 10 by the press-down operation made on the pump head part 32.

As illustrated in FIG. 6, the head part 30 has a reservoir 60 that reserves the foamy liquid agent (foam B) delivered from the container body 40. The reservoir 60 is a void that decelerates the foamy liquid agent (foam B) delivered from the container body 40 through the nozzle part 52, and feeds the foam B so as to be distributed over the entire portion of the outlet 20. The reservoir 60 is arranged on the flow channel of the foam B, between the nozzle opening 54 of the nozzle part 52 and the outlet 20, whose flow channel is made wider than the nozzle opening 54 and the outlet 20. The reservoir 60 in this embodiment is formed inside the foam dispenser attachment 10 that constitutes the head part 30, and between the outlet 20 and the fitting part 16. In this embodiment, the reservoir 60 is provided on the flow channel for the foam B, particularly on the upstream side of the outlet 20 so as to adjoin therewith. The fitting part 16 is provided so as to be opened on the base side (the righthand side in the drawing), of the reservoir 60. The engagement part 18 is formed so as to project from the base side of the reservoir 60, and engages with the nozzle part 52 from the lower side thereof. The reservoir 60 has a ceiling 66 that inclines towards the front end side (the lefthand side of the drawing) in the feeding direction of the liquid agent L, and downward towards the outlet 20. The internal height of the reservoir 60 reduces towards the front end of the feeding direction of the liquid agent (foam B).

Since the head part 30 (foam dispenser attachment 10), having the outlet 20 opened therein, has the reservoir 60, the foam B delivered from the container body 40 is temporally reserved in the reservoir 60, and then uniformly dispensed downward over the entire portion of the outlet 20. The foam B is therefore prevented from being dispensed predominantly on the front end side (the lefthand side in FIG. 6) of the outlet 20 in the feeding direction of the foam B, but instead dispensed uniformly through the entire portion of the outlet 20. The foam B delivered from the container body 40 tends to decelerate inside the reservoir 60 particularly on the front end side thereof, and to stagnate therein. In contrast, since the reservoir 60 in this embodiment has the ceiling 66 that declines towards the outlet 20, so that the foam B that is delivered from the container body 40 and collides on the ceiling 66 turns the direction towards the outlet 20. In this way, the foam B having been delivered from the container body 40 to the foam dispenser attachment 10, as a result of press-down operation made on the pump head part 32, is prevented from excessively stagnating in the front end side of the reservoir 60, and thus can be smoothly dispensed through the outlet 20. Owing to that the internal height of the outlet 20 decreases towards the front end side of the feeding direction of foam B, or, towards the distal side away from the nozzle opening 54, the foam B decelerated inside the reservoir 60 is prevented from stagnating in the front end side of the reservoir 60. With such design, a uniform amount (predetermined amount) of foam B may be dispensed through the outlet 20 each time the pump head part 32 is pressed down, and thereby reproducibility of the foam object FB built up after dispensed through the outlet 20 will be improved. Although the capacity of the reservoir 60 is not specifically limited, it is preferably smaller than the volume of the foam B dispensed through the nozzle opening 54 when the pump head part 32 is pushed only once (that is, the total volume of the dispensed liquid agent L and the air entrained into the liquid agent L). With such design, the foam B passed through the nozzle opening 54 of the nozzle part 52 is rapidly dispensed through the outlet 20 to give the intended shape, and the volume of the foam B remaining in the head part 30 (foam dispenser attachment 10) may be reduced.

As described above, the head part 30 of the foam dispensing container 100 has the nozzle part 52. The nozzle part 52 of this embodiment dispenses the foamy liquid agent (foam B), delivered from the container body 40, obliquely downward inside the reservoir 60. The head part 30 (the foam dispenser attachment 10 in this embodiment) has an inclined face 62 that nearly confronts such obliquely downward direction. The inclined face 62 is provided inside the reservoir 60, and is formed between the wide guide part 28 and the narrow guide part 27. With such design, the foam B dispensed through the nozzle opening 54 towards the foam dispenser attachment 10 collides on the inclined face 62 to decelerate itself, and is uniformly filled inside the reservoir 60. The foam B is then dispensed downward through the outlet 20. The outlet 20 is formed so as to extend between the front end side and the base side of the inclined face 62 (see FIG. 10). In other words, the base side of the foam dispenser attachment 10, which is in proximity to the fitting part 16, is a portion where the foam B jetted through the nozzle opening 54 tends to pass the outlet, and is less likely to dispense the foam B as compared with the front end side. Now by forming the inclined face 62 inside the reservoir 62 as in this embodiment to decelerate the foam B, the amount of dispensed foam B may be made uniform over the front end side and the base side of the outlet 20.

The dispensing guide 26 is provided so as to extend downward from the reservoir 60. The foam B, having been decelerated inside the reservoir 60 and once reserved therein, flows into the dispensing guide 26, guided downward, and dispensed through the outlet 20. With the dispensing guide 26 provided below the reservoir 60, the foam B dispensed through the outlet 20 is reduced to swell. More specifically, the foam B has a lower bulk density and is highly compressive as compared with the liquid agent L in the liquid form, and thereby the foam B delivered through the nozzle opening 54 to the reservoir 60 and reserved there is compressed. For this reason, the foam B largely swells if the length of passage of the dispensing guide 26 is short. In contrast, if the length of passage of the dispensing guide 26 is long, the foam B is gradually depressurized as it passes through the dispensing guide 26, and is also rectified during passage through the dispensing guide 26. This advantageously stabilizes the shape of the dispensed foam B, and suppresses the dispensed foam B from swelling, so that the foam object FB with intended shape will be built up in a finely profiled manner.

As illustrated in FIG. 6, the internal bottom face 64 of the reservoir 60 is made higher in the front end side (internal bottom face 64*b*), than in the base side (internal bottom face 64*a*) of the inclined face 62 (see also FIG. 8). The dispensing guide 26 has the upper end defined by the internal bottom face 64 of the reservoir 60, and has the lower end defined by the outlet 20. Accordingly, the height at which the dispensing guide 26 starts (upper end height) is lower than the inclined face 62 on the base side, and higher than the inclined face 62 on the front end side. As illustrated in FIG. 4, the outlet 20 is formed so as to lie horizontally at the bottom end of the dispensing guide 26. The path length of the dispensing guide 26 (vertical length in FIG. 4 and FIG. 6) is therefore made longer on the front end side (the lefthand side in FIG. 4) of the inclined face 62, than on the base side (the righthand side in FIG. 4). This properly suppresses the dispensed foam B from swelling after dispensed through the front end side of the outlet 20. Accordingly, even if the number of times or stroke of the press-down operation made on the pump head part 32 should vary, and thereby the amount of dispensed foam B should vary to some extent, the desired foam object FB with intended shape may be built stably. The outlet 20 of this embodiment is designed to allow a larger amount of foam B to pass through the widely-opened part 24 formed on the front end side of the reservoir 60 as described later. Accordingly, by presetting a longer path length to the dispensing guide 26 corresponding the widely-opened part 24 as described above, it is now possible to equalize the rate of swelling of dispensed foam B having passed respectively through the front end side and the base side of the outlet 20.

The head part 30 may have inside thereof a net body (not illustrated) through which the foamy liquid agent L delivered from the container body 40 is allowed to pass. Although the position of placement of the net body is not specifically limited, it is preferable to place at least a part of the net body inside the dispensing guide 26, or adjacent to the dispensing guide 26. In particular, the net body is preferably placed in the vicinity of the outlet 20.

By providing the net body in the vicinity of the outlet 20, the liquid agent L is prevented from dripping, even if the dispensing direction of foam B should be downward like in this embodiment. More specifically, while the liquid agent L in the state of foam B may otherwise return back to the liquid form with time due to collapse of bubbles, the net body provided close to the outlet 20 will help the liquid agent L in the liquid form adhere thereon, and prevent the liquid agent L from dripping from the outlet 20. Since the foam B passes through the net body immediately before being dispensed through the outlet 20, a further fine-bubbled foam may be produced.

The net body is a mesh or other porous body. The net body may be a mesh obtained by weaving warps and wefts, made of metal or resin, into plain weave or twilled weave (woven wire net), or may be a perforated screen plate obtained by perforating a sheet-like base to form therein a large number of fine throughholes. Although dimensional relation between the openings of the net body and the aforementioned air-liquid contact portion 51 is not specifically limited, the opening of the net body may be set larger than the opening of the air-liquid contact portion 51. With such setting, pressure loss at the net body may be reduced, and thereby the pressing force on the pump head part 32, necessary for dispensing the foam B through the outlet 20, is prevented from excessively increasing. For the net body and the air-liquid contact portion 51 composed of a plain weave or twilled weave, the opening is determined based on the diameter of the line material and the mesh count (number of line materials per inch). For the net body and the air-liquid contact portion 51 composed of a perforated plate, the opening is determined based on the averaged diameter of the fine throughholes individually approximated to circles.

In this embodiment, the net body may be placed on the base side of the feeding direction of the liquid agent L, relative to the outlet 20. The net body may be placed so as to cover the entire portion of the outlet 20 that is composed of the widely-opened part 24 and the narrowly-opened parts 22*a*, 22*b*. A part of the net body may be placed so as to extend over the internal bottom face 64*a* and the inclined face 62 illustrated in FIG. 6. Other part of the net body may be positioned inside the dispensing guide 26, particularly near the lower end thereof adjoining to the outlet 20 (widely-opened part 24). Note however that, as an alternative to the above-described embodiment, the net body may be placed so as to cover the widely-opened part 24 only, without placing it over the narrowly-opened parts 22*a*, 22*b*. That is, since it is anticipated that dripping of the liquid agent L returned back to liquid would occur particularly at the widely-opened part 24, so that only the widely-opened part 24 may selectively be covered with the net body. In this way, the foam object FB with intended shape may be built up while avoiding shortage of the foam B to be fed to the narrowly-opened parts 22*a*, 22*b*, and while preventing dripping from the outlet 20.

Figure 8A:
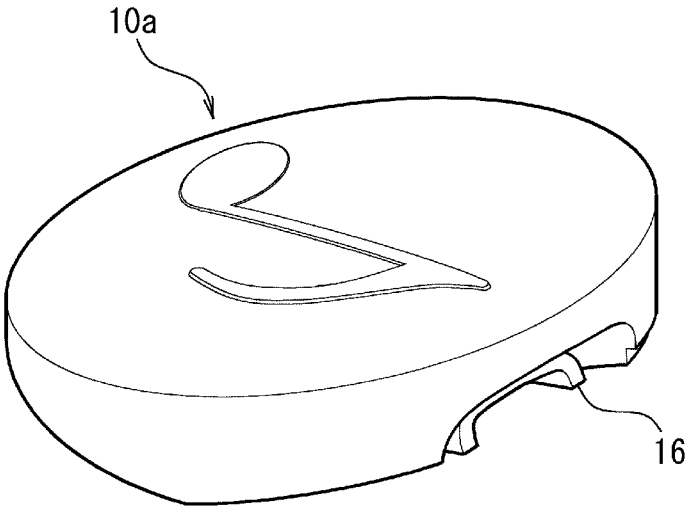
FIG. 8A is a top perspective view illustrating an upper half of the foam dispenser attachment.
Figure 8B:
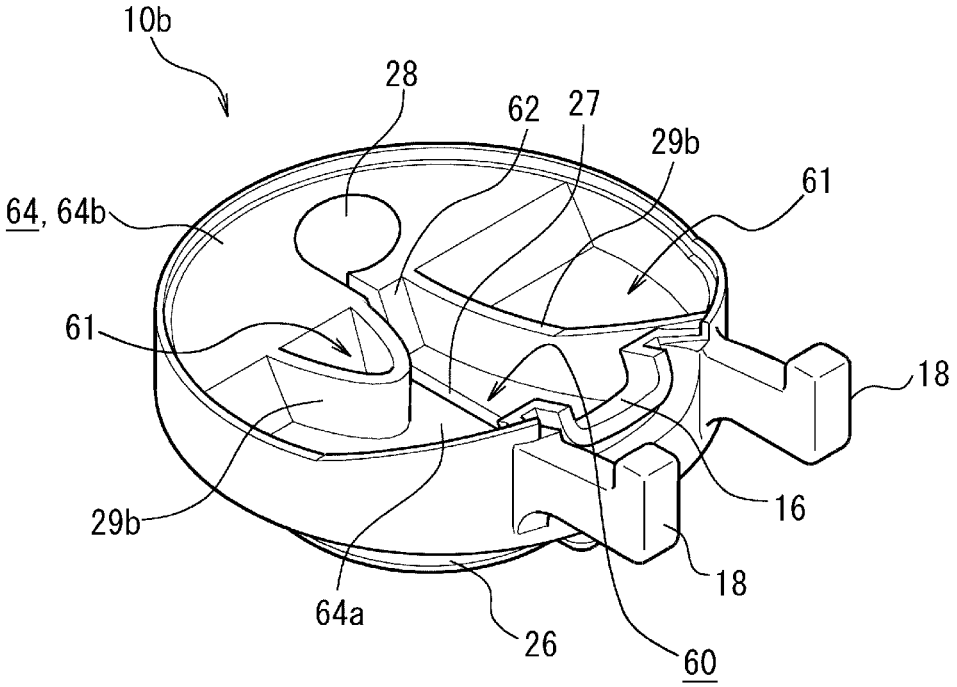
FIG. 8B is a top perspective view illustrating a lower half.
Figure 9:
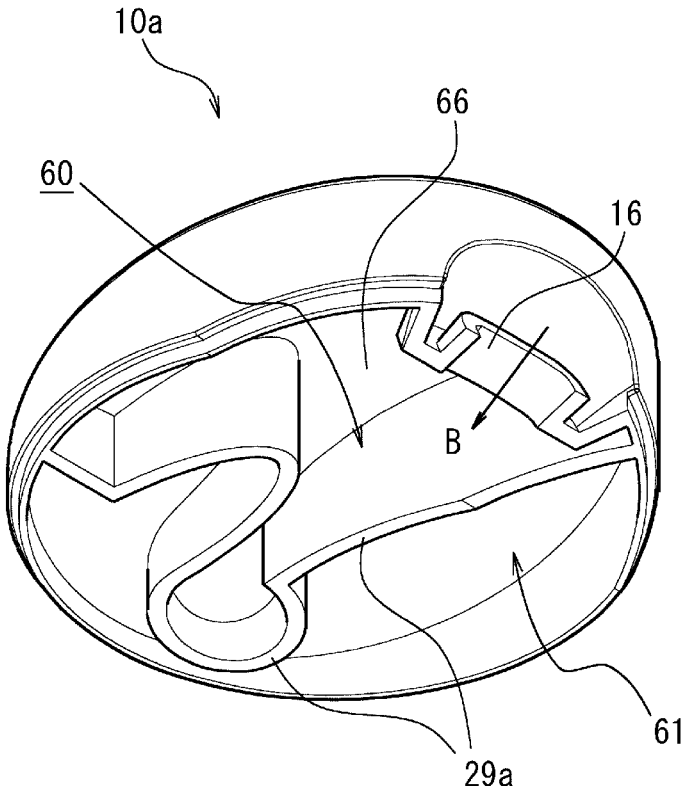
FIG. 9 is a bottom perspective view illustrating the upper half of the foam dispenser attachment.
Figure 10:
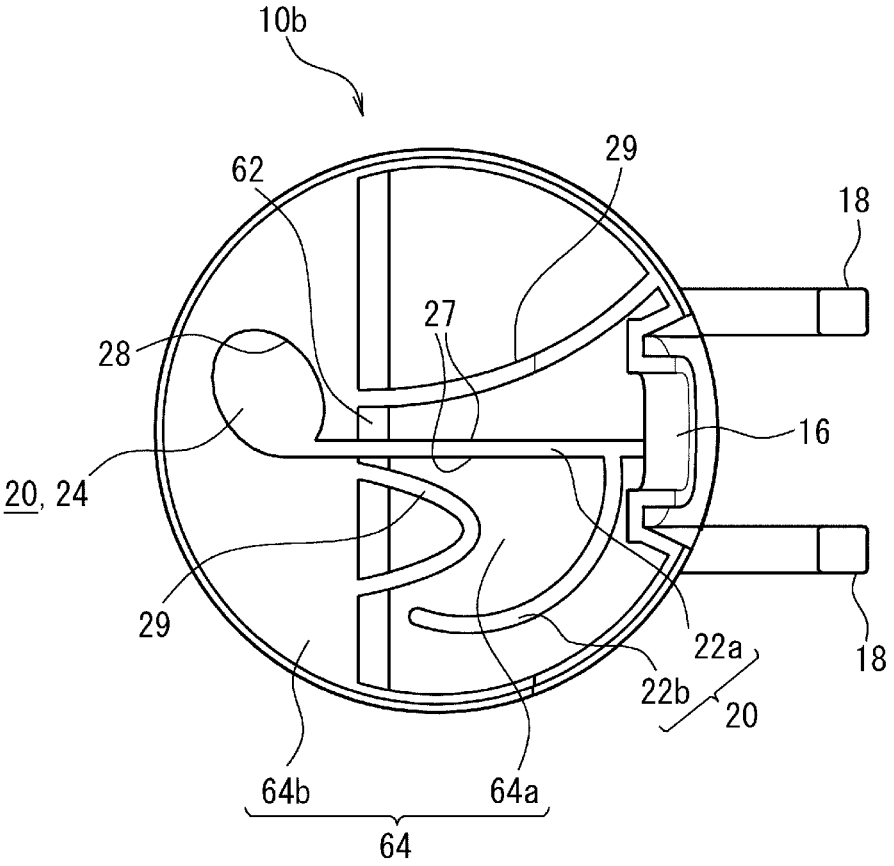
FIG. 10 is a plan view illustrating the lower half of the foam dispenser attachment.

FIG. 8A is a top perspective view of an upper half 10*a* of the foam dispenser attachment 10, and FIG. 8B is a top perspective view of a lower half 10*b*. FIG. 9 is a bottom perspective view of the upper half 10*a*. FIG. 10 is a plan view of the lower half 10*b*.

The foam dispenser attachment 10 is configured by mutually combining the upper half 10*a* and the lower half 10*b* in the dispensing direction. The lower half 10*b* has the outlet 20 formed so as to open therein. This configuration facilitates formation of the reservoir 60 that has the inclined face 62 and an inner guide 29 described later, inside the foam dispenser attachment 10. After the foam dispenser attachment 10 was assembled, the upper half 10*a* and the lower half 10*b* may be joined unseparably, typically by using an adhesive. The upper half 10*a* and the lower half 10*b* may be formed typically by injection molding of a synthetic resin.

The outlet 20 has the linear narrowly-opened part 22, and the widely-opened part 24 that is formed contiguously with the narrowly-opened part 22 and is made wider than the narrowly-opened part 22. The widely-opened part 24 is placed on the front end side of the inclined face 62, and the narrowly-opened part 22 is placed on the base side. As illustrated in FIG. 2, the dispensing guide 26 has a narrow guide part 27 formed to oppose by sandwiching the narrowly-opened part 22, and a wide guide part 28 disposed along the widely-opened part 24. The narrow guide part 27 and the wide guide part 28 communicate with each other while bounded nearly by the width of the narrow guide part 27.

The outlet 20 of this embodiment has a straight narrowly-opened part 22*a* that corresponds to the stem of eighth note, a curved narrowly-opened part 22*b* that corresponds to the flag, and a widely-opened part 24 that corresponds to the head. The dispensing guide 26 is formed so as to surround the circumference of the outlet 20 in a plan view as illustrated in FIG. 10.

With such design, the foam object FB with intended shape, molded after a musical note (eighth note) as illustrated in FIG. 3A, may be built up by dispensing. The foam B dispensed through the narrowly-opened parts 22*a*, 22*b* build the narrow portion NP of the foam object FB, meanwhile the foam B dispensed through the widely-opened part 24 builds the wide foam portion WP of the foam object FB. Owing to that the narrow guide part 27 and the wide guide part 28 communicate with each other while bounded nearly by the width of the narrow guide part 27, the width of the foam object FB abruptly changes at the boundary of the wide foam portion WP and the narrow portion NP. By using the foam dispenser attachment 10 of this embodiment, it is now possible to build up such finely-profiled foam object FB with intended shape by dispensing operation.

The widely-opened part 24 is disposed on the front end side (the lefthand side in FIG. 10) of the foam dispenser attachment 10, and the narrowly-opened parts 22*a* and 22*b* are disposed on the base side (the righthand side in FIG. 10) closer to the fitting part 16. As described above, since the path length of the dispensing guide on the front end side of the foam dispenser attachment 10 is made longer than the path length of the dispensing guide on the base end side, so that the foam B after passed through the widely-opened part 24 is suppressed from swelling. In this way, the wide foam portion WP of the foam object FB illustrated in FIG. 3A is prevented from excessively swelling, so that the foam object FB with the desired intended shape may be built up even if the amount of dispensed foam B should vary to some extent.

The plurality of linear narrowly-opened parts 22*a*, 22*b* of the outlet 20 in this embodiment cross each other. As illustrated in FIG. 10, the curved narrowly-opened part 22*b* that corresponds to the flag of musical note (eighth note) crosses near the end of the straight narrowly-opened part 22*a* that corresponds to the stem of the note, more specifically crosses at a position slightly set back inwardly from the terminal end. Such intersection will have a relatively large amount of dispensed foam B since the foam B came from the narrowly-opened parts 22*a* and 22*b* will combine there. In this way, as illustrated in FIG. 3A, the dispensed foam object FB will be built up as if the flag of eighth note is joined to the very end of the stem.

As illustrated in FIG. 8B, on the internal bottom face 64*a* on the base side of the inclined face 62, inner guides 29*b* are provided so as to extend vertically. The inner guides 29*b* are provided on both sides of the narrow guide part 27.

As illustrated in FIG. 9, the upper half 10*a* of the foam dispenser attachment 10 has an inner guide 29*a*. The inner guide 29*a* surrounds, in a plan view, at least a part of the circumference of the outlet 20 (see FIG. 10) like a wall. The inner guide 29*a* is formed so as to suspend down from the ceiling 66 of the upper half 10*a*. The inner guide 29*a* of the upper half 10*a* and the inner guide 29*b* of the lower half 10*b* (see FIG. 8B) are butted to define a compartment of the reservoir 60, when the upper half 10*a* and the lower half 10*b* are assembled.

The inner guide 29*a* of the upper half 10*a* is provided so as to surround a portion of the circumference of the outlet 20, particularly around the front end side of the feeding direction (indicated by an arrow in FIG. 9) of the liquid agent (foam B) delivered from the container body 40 towards the foam dispenser attachment 10. The fitting part 16 is provided to the inner guide 29*a*, particularly on the base side of the feeding direction of the liquid agent (foam B).

The inner guides 29*a* and 29*b* partition the inside of the foam dispenser attachment 10 into the reservoir 60 that communicates with the outlet 20, and a closed area 61 that does not communicate with the outlet 20. The fitting part 16 communicates with the reservoir 60 formed on the inner side of the inner guide 29*a*. As a consequence, inside the foam dispenser attachment 10, there are formed the reservoir 60 that constitutes the flow channel of the foam B, and the closed area 61 the foam B cannot enter. With the closed area 61 formed inside the foam dispenser attachment 10, the volume of reservoir 60 relative to the total volume of foam dispenser attachment 10 is suppressed. It is therefore possible to reduce the amount of foam B that might remain in the reservoir 60 and vanish, rather than dispensed through the outlet 20.

Modified Examples of Foam Dispenser Attachment

Modified examples of the foam dispenser attachment 10 of the first embodiment will be explained.

FIG. 11A to FIG. 14A are schematic bottom views of foam dispenser attachments 11 to 14 according to a first modified example to a fourth modified example. FIG. 11B to FIG. 14B are plan views of the foam objects FB respectively dispensed through foam dispenser attachments 11 to 14 of the first modified example to the fourth modified example.

Figure 11A:
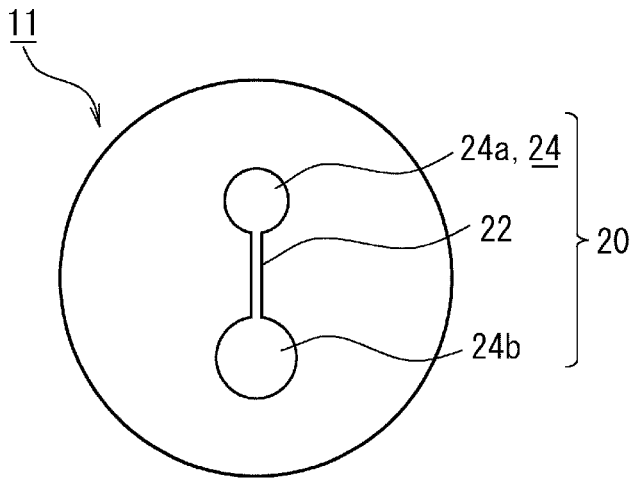
FIG. 11A is a schematic bottom view illustrating a foam dispenser attachment of a first modified example.
Figure 12A:
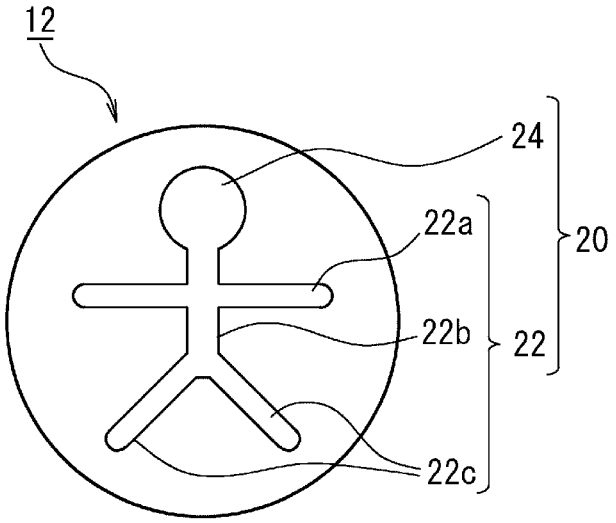
FIG. 12A is a schematic bottom view illustrating a foam dispenser attachment of a second modified example.
Figure 12B:
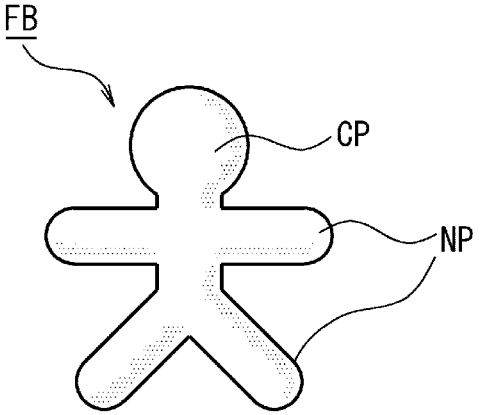
FIG. 12B is a plan view of a foam object dispensed through the foam dispenser attachment of the second modified example.

As illustrated in FIG. 11A and FIG. 12A, the foam dispenser attachments 11, 12 of the first modified example and the second modified example are same as the foam dispenser attachment 10 of the first embodiment (see FIG. 10) in that each of their outlets 20 has the linear narrowly-opened part 22, and the widely-opened part 24 that is formed contiguously with the narrowly-opened part 22 and is made wider than the narrowly-opened part 22. It is same as the foam dispenser attachment 10 of the first embodiment also in that each of their widely-opened parts 24 is near circular with the diameter larger than the width of the narrowly-opened part 22.

Figure 11B:
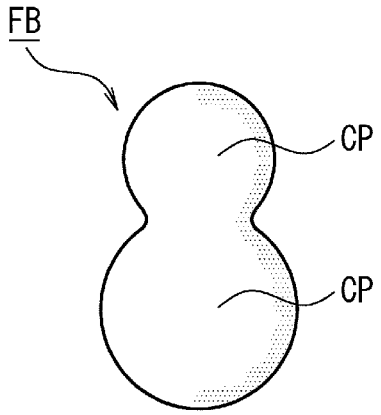
FIG. 11B is a plan view of a foam object dispensed through the foam dispenser attachment of the first modified example.

Meanwhile, the first modified example is different from the first embodiment in the aspects below. That is, as illustrated in FIG. 11B, at least a part of the intended shape of the foam object FB, built up after dispensed through the foam dispenser attachment 11 of the first modified example, is shaped such that a plurality of near circular portions CP are overlapped in a plan view. The outlet 20 of the first modified example has a plurality of near-circular, widely-opened parts 24 (24*a*, 24*b*) that are shrunk from the plurality of near-circular portions CP in the intended shape, and the linear narrowly-opened part 22 that connects these widely-opened parts 24 (24*a*, 24*b*). The widely-opened parts 24 (24*a*, 24*b*) are portions less likely to be clogged even if the liquid agent L should solidify. With such widely-opened parts 24*a*, 24*b* formed contiguously with the narrowly-opened part 22 on both ends thereof, even if the liquid agent L should solidify to clog the narrowly-opened part 22, the foam B can still be dispensed through both sides of the clogged portion, so that the solidified component can be kept in contact with the foam B (liquid agent L). As a consequence, the solidified component can be softened or dissolved, entrained by the dispensed foam B, and dispensed through the narrowly-opened part 22. Clogging is thus avoidable.

The foam object FB built up after dispensed through the foam dispenser attachment 11 of the first modified example looks snowman in a plan view. Note that, as a further modified example of the first modified example, the foam object FB may be shaped such that three or more near-circular portions CP are overlapped. In this case, the outlet 20 is preferably composed of three or more near-circular, widely-opened parts 24, and the linear narrowly-opened parts 22 that mutually connect them.

Figure 13A:
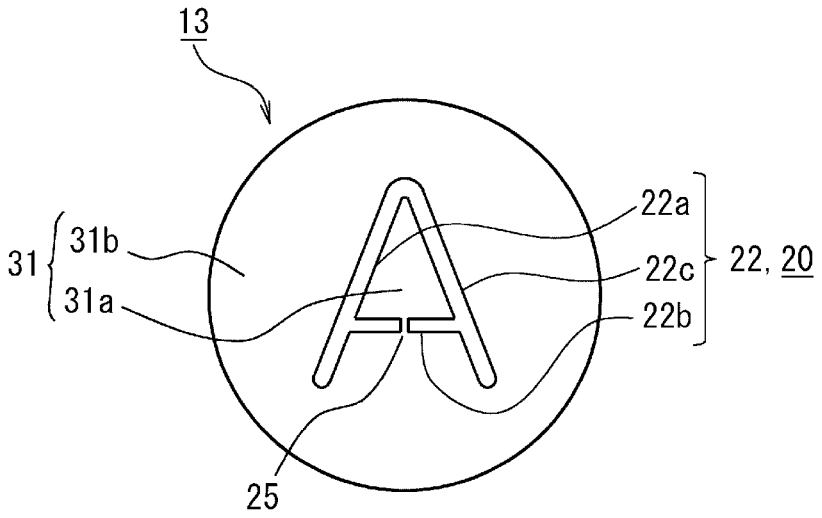
FIG. 13A a schematic bottom view illustrating a foam dispenser attachment of a third modified example.
Figure 13B:
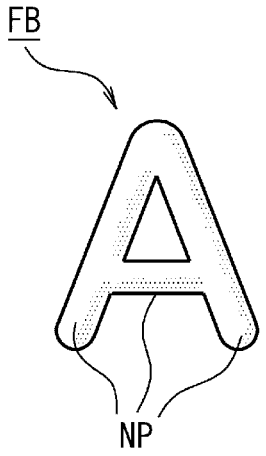
FIG. 13B is a plan view of a foam object dispensed through the foam dispenser attachment of the third modified example.

The outlets 20 of the second modified example and the third modified example illustrated in FIG. 12A and FIG. 13A are same as the first embodiment in that they have a plurality of linear narrowly-opened parts 22 (22*a* to 22*c*) that cross each other, but different from the foam dispenser attachment 10 of the first embodiment in that one narrowly-opened part 22*a* branches into, or crossed with, other narrowly-opened part 22*b*.

The foam object FB built up after dispensed through the foam dispenser attachment 12 of the second modified example looks like human in a plan view. The foam object FB built up after dispensed through the foam dispenser attachment 13 of the third modified example looks like a letter (letter "A" in this modified example) in a plan view. Any one of the narrowly-opened parts 22*a* to 22*c* (the narrowly-opened part 22*b* in this modified example) is divided into a plurality of sections, leaving a separation region 25 in between. In the bottom face 31 of the foam dispenser attachment 13, an inner region 31*a* surrounded by the narrowly-opened parts 22*a* to 22*c*, and an outer region 31*b* around the narrowly-opened parts 22*a* to 22*c* are bridged together by the separation region 25. The foam dispenser attachment 13 may therefore be molded easily, and the outlet 20 is suppressed from being deformed contingently due to relative displacement of the inner region 31*a* and the outer region 31*b* under dispensing pressure of the foam B. The separation region 25 may be provided to a plurality of points of the narrowly-opened parts 22*a* to 22*c*. The length of the separation region 25, or the divisional distance of the narrowly-opened part 22*b* is preferably short as possible, so as to give the intended shape to the foam object FB, and may typically be made narrower than the line width of the narrowly-opened part 22*b*. As an alternative to the embodiment described above, the inner region 31*a* and the outer region 31*b* may be joined with a bridge (not illustrated) provided inside the foam dispenser attachment 13. With such design, each of the narrowly-opened parts 22*a* to 22*c* may be formed as a contiguous line segment, while disusing the separation region 25.

Figure 14A:
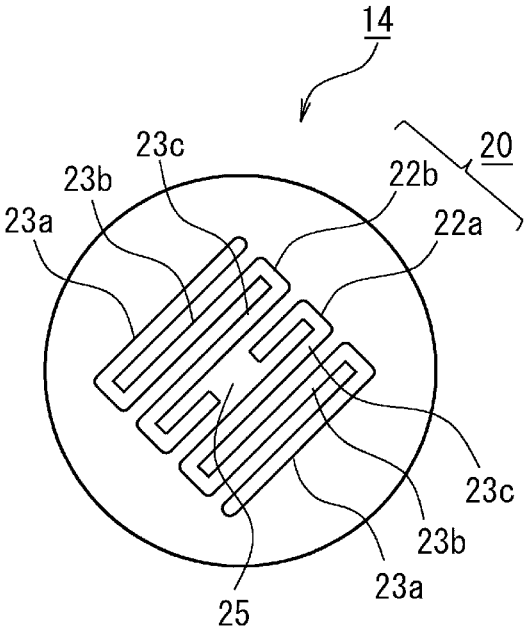
FIG. 14A a schematic bottom view illustrating a foam dispenser attachment of a fourth modified example.
Figure 14B:
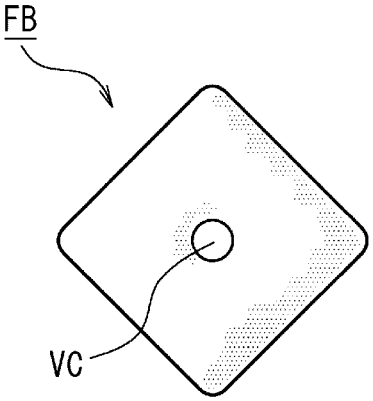
FIG. 14B is a plan view of a foam object dispensed through the foam dispenser attachment of the fourth modified example.

The outlet 20 of the fourth modified example illustrated in FIG. 14A is different from the foam dispenser attachment 10 of the first embodiment, in that it has a series of bent or meandering linear narrowly-opened parts 22*a*, 22*b*. Each of the narrowly-opened parts 22*a*, 22*b* has a plurality of line segments 23*a* to 23*c* laid in parallel to each other. The line segments 23*a* to 23*c* are placed in proximity, and the intervals are determined so that the foamy liquid agent (foam B) dispensed through the outlet 20 can swell in the width direction, and then can be crowded to each other to give a planar shape. As illustrated in FIG. 14B, at least a part of the intended shape of the foam object FB built up after dispensed through the foam dispenser attachment 14 has a planar shape in a plan view.

The narrowly-opened parts 22*a*, 22*b* are partial outlets, and jointly constitute the outlet 20. The narrowly-opened parts 22*a*, 22*b* of the fourth modified example meander like comb teeth, and the end portions are spaced from each other. In other words, the foam dispenser attachment 14 has the separation region 25 between the narrowly-opened parts 22*a*, 22*b* as the partial outlets. The foam B is not dispensed from the separation region 25, so that the foam object FB will have a vacant portion VC.

The foam dispenser attachment 14 of the fourth modified example builds up the planar intended shape, by gathering the foam B respectively dispensed through the line segments 23*a* to 23*c*. In other words, when the intended shape of the foam object FB is planar, it is recommendable to virtually divide the plane into a plurality of regions, and to allocate the contiguous partial outlets of the outlet 20, each of which being narrowed from each region. With such design, the foam object FB having a large area or a complicated shape may accurately be built up with the foam B.

In conclusion, as represented by the foam dispenser attachments 10 to 14 of the first embodiment, and of the first to fourth modified examples, the outlet 20 used in this invention may have a variety of opening geometries.

Second Embodiment

Figure 15:
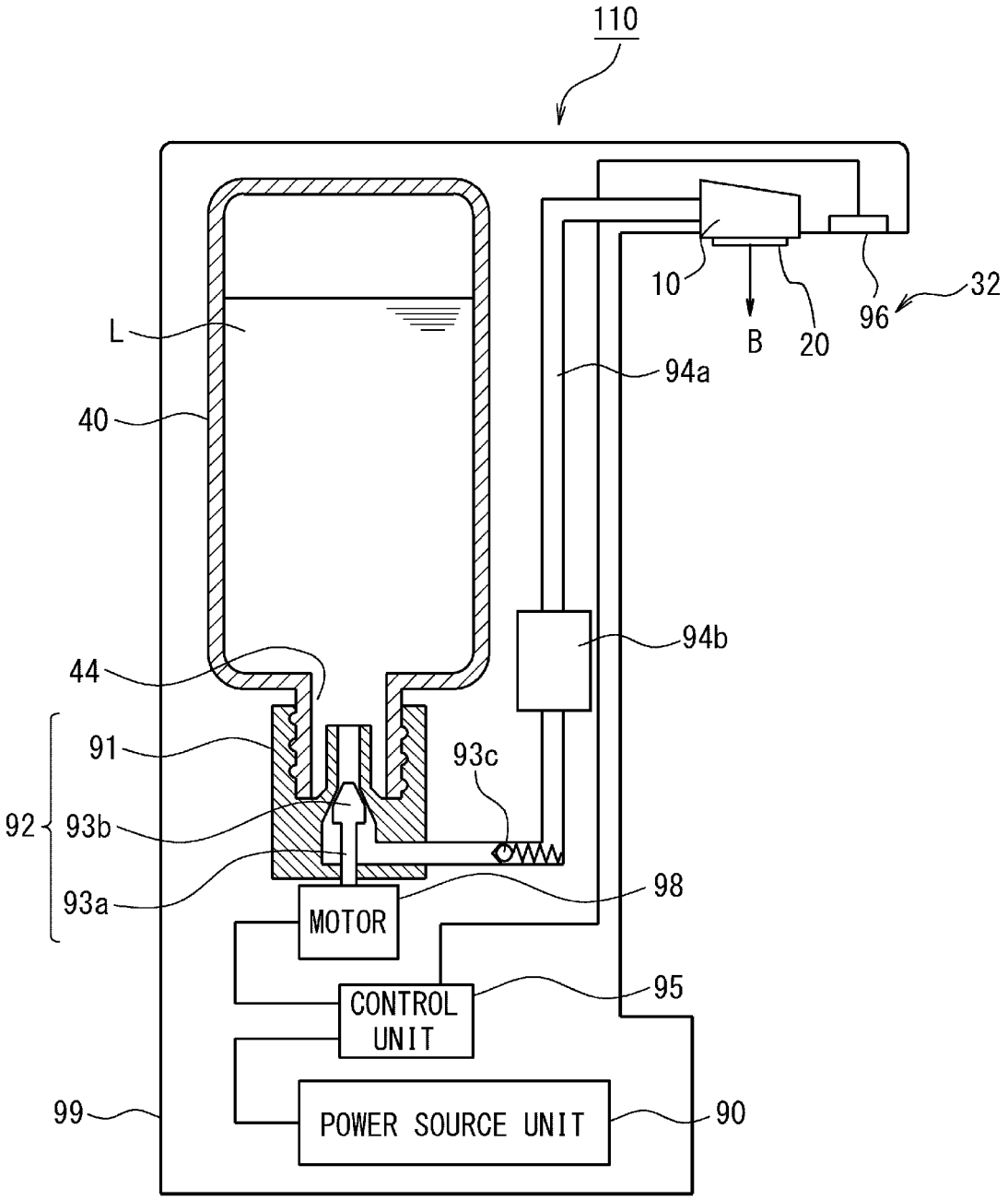
FIG. 15 is an explanatory drawing illustrating a structure of the foam dispensing container of a second embodiment.

FIG. 15 is an explanatory drawing illustrating a structure of the foam dispensing container 110 of a second embodiment.

The foam dispensing container 110 of the second embodiment is different from the foam dispensing container 100 of the first embodiment (see FIG. 1), in that it dispenses the foam B while being electrically actuated. The foam dispensing container 110 of this embodiment has a power source unit 90, a pump mechanism 92 that is powered by the power source unit 90 and delivers the liquid agent L from the container body 40, and a control unit 95 that controls operation of the pump mechanism 92. The dispensing operation part of the second embodiment includes a sensing part 96 that senses approach or input operation of the user. The control unit 95 activates a motor 98 and the pump mechanism 92 upon detecting the approach or input operation of the user by the sensing part 96, and makes them dispense the predetermined amount of foamy liquid agent (foam B) through the outlet 20.

The foam dispensing container 110 of the second embodiment is different from the foam dispenser attachment 10 of the first embodiment (see FIG. 1), in that the foam dispenser attachment 10 is attached to an enclosure 99 permanently, rather than detachably. According to the foam dispensing container 110 of the second embodiment, the foam dispenser attachment 10 is disposed inside the enclosure 99, with the outlet 20 exposed from the enclosure 99.

The pump mechanism 92 has a reservoir 91, a piston 93*a*, a plunger 93*b* and a check valve 93*c*. The container body 40 with the liquid agent L reserved therein is set upside down in the enclosure 99 while directing the bottleneck downward. The reservoir 91 accepts the liquid agent L from the container body 40. The piston 93*a* is actuated by the motor 98, and reciprocally drives the plunger 93*b* to close the flow channel of the reservoir 91 in a freely openable/closable manner. The check valve 93*c* allows the liquid agent L to flow unidirectionally from the reservoir 91 towards the foam dispenser attachment 10, while preventing backflow.

The motor 98 is powered by the power source unit 90, and the operation thereof is controlled by the control unit 95. As the power source unit 90, a dry cell is typically used. The sensing part 96 is a proximity sensor that is disposed near the outlet 20 of the foam dispenser attachment 10, and detects approach of the user's hand. The sensing part 96 is typically a reflective sensor having an infrared transceiver. When the sensing part 96 detects approach of the user's hand, a detection signal is sent to the control unit 95 and used for activating the motor 98.

In the middle of a tube path 94*a* that constitutes the flow channel of liquid agent L, connecting the reservoir 91 and the foam dispenser attachment 10, there is provided an air-liquid contact portion 94*b*. When the piston 93*a* is positioned at the top dead center as illustrated in FIG. 15, the inlet of the reservoir 91 is closed with the plunger 93*b* to inhibit traffic of the liquid agent L between the container body 40 and the reservoir 91. The motor 98 rotates a cam (not illustrated) to reciprocate the piston 93*a*. As the piston 93*a* descends, the inlet of the reservoir 91 is released, the liquid agent L enters the reservoir 91, and the plunger 93*b* pushes the liquid agent L towards the foam dispenser attachment 10. The pushed liquid agent L is transformed into foam in the air-liquid contact portion 94*b*, delivered to the foam dispenser attachment 10, and dispensed through the outlet 20 to build up the foam object FB with intended shape (see FIG. 3).

Upon receiving a detection signal from the sensing part 96, the control unit 95 activate the motor 98 so as to reciprocate the piston 93*a* a preset number of times. In this way, a predetermined amount of liquid agent L is dispensed as the foam B through the outlet 20.

As seen in the foam dispensing container 110 of the second embodiment, the foam dispenser attachment 10 may be used while attached to the enclosure 99. Alternatively, as seen in the foam dispensing container 100 of the first embodiment (see FIG. 1), the foam dispenser attachment 10 may be used while detachably attached to the pump head part 32.

Third Embodiment

Figure 16:
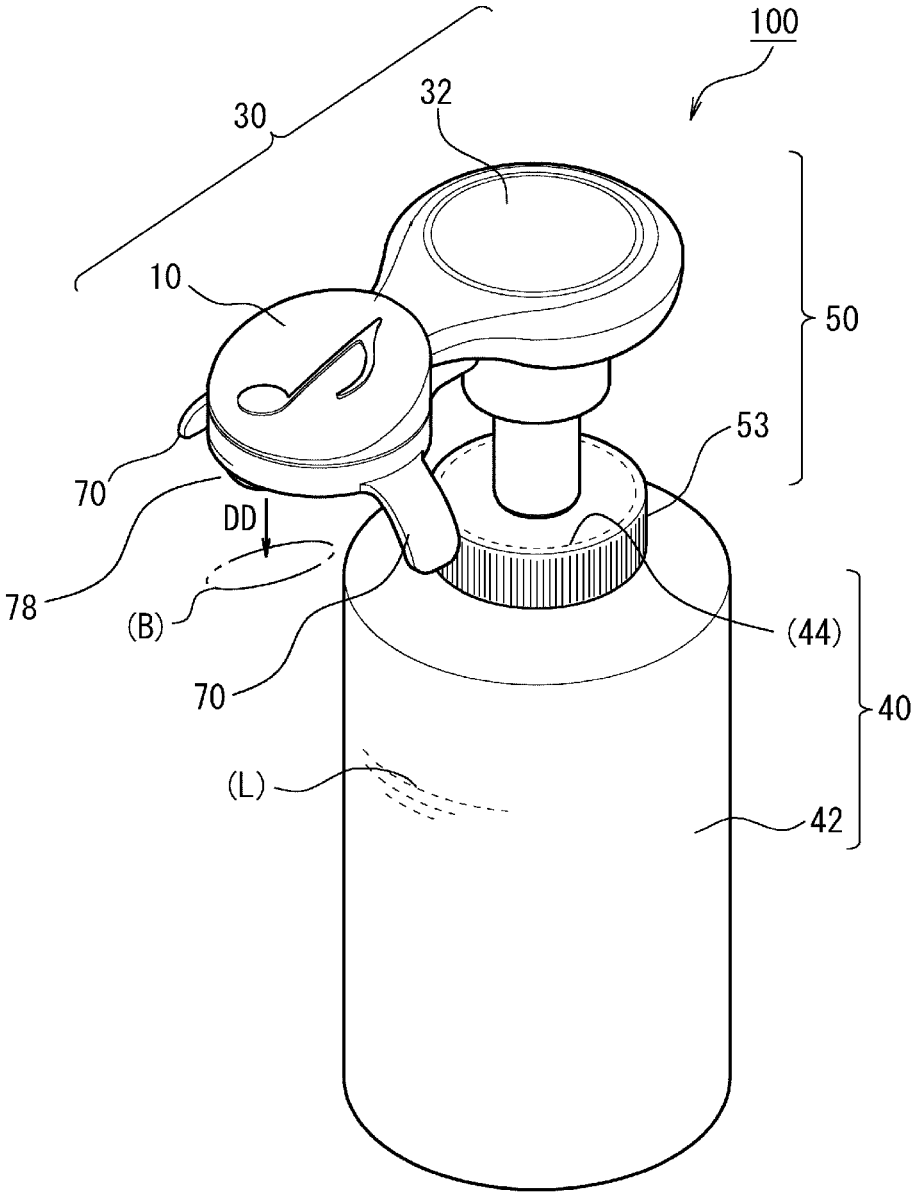
FIG. 16 is a top perspective view illustrating a foam dispensing container of a third embodiment.
Figure 17:
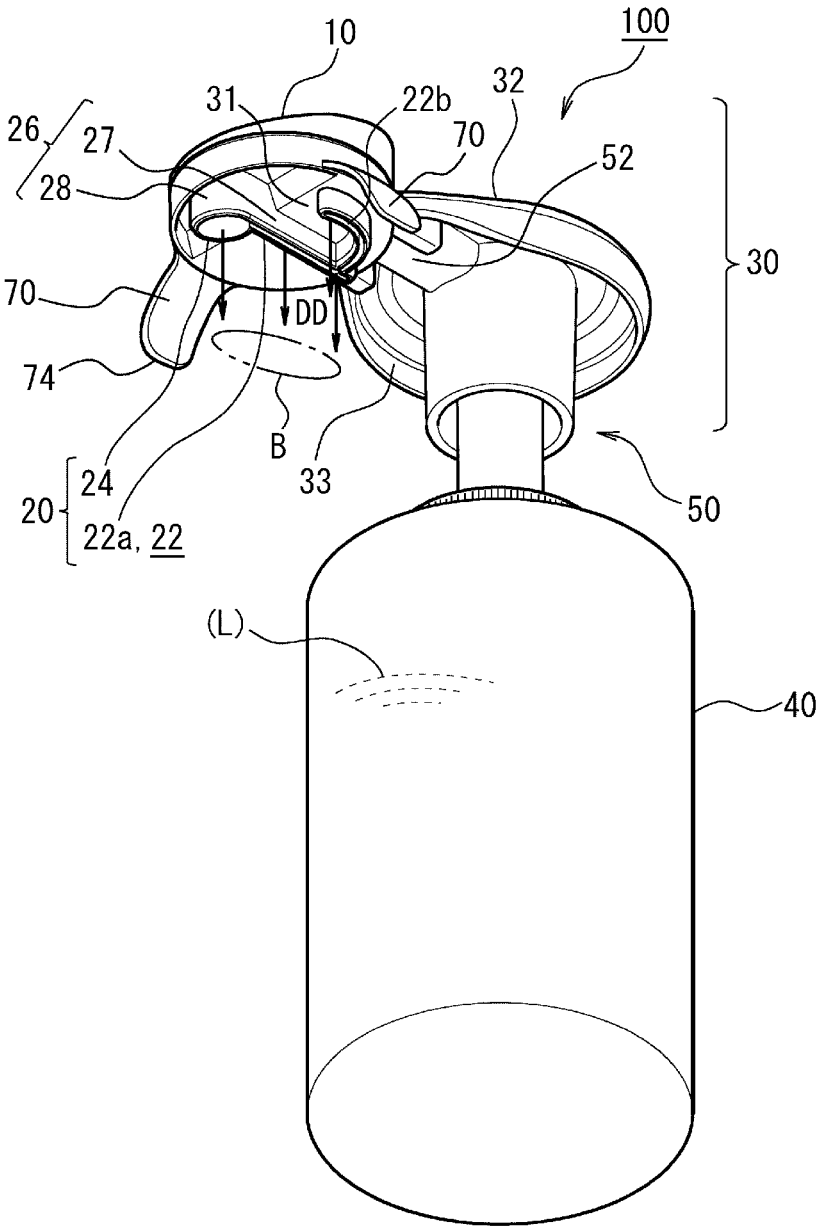
FIG. 17 is a bottom perspective view illustrating the foam dispensing container.
Figure 18A:
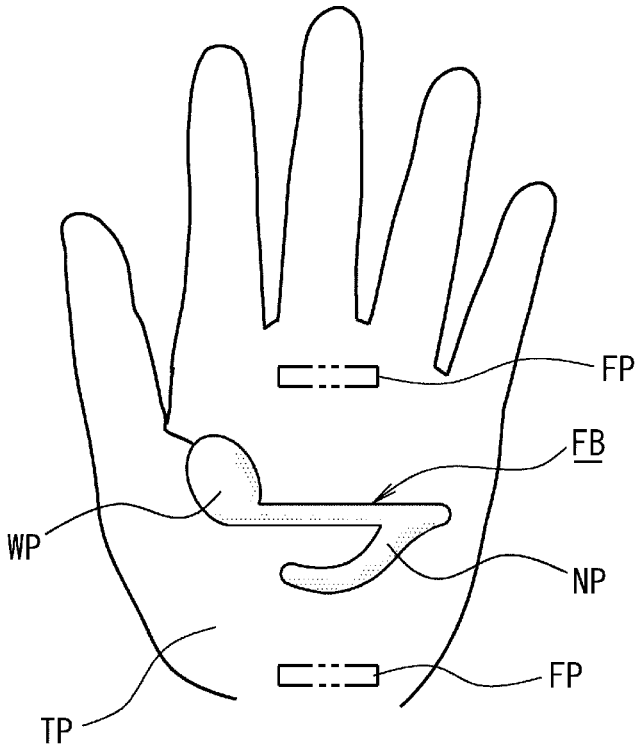
FIG. 18A is a plan view illustrating a dispensed foam object.
Figure 18B:
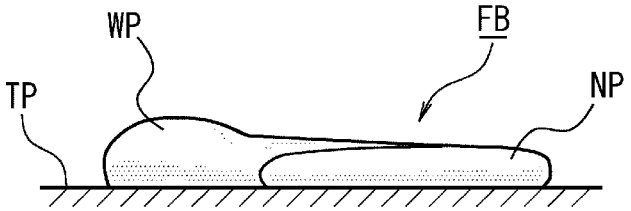
FIG. 18B is a front elevation of the foam object.
Figure 19:
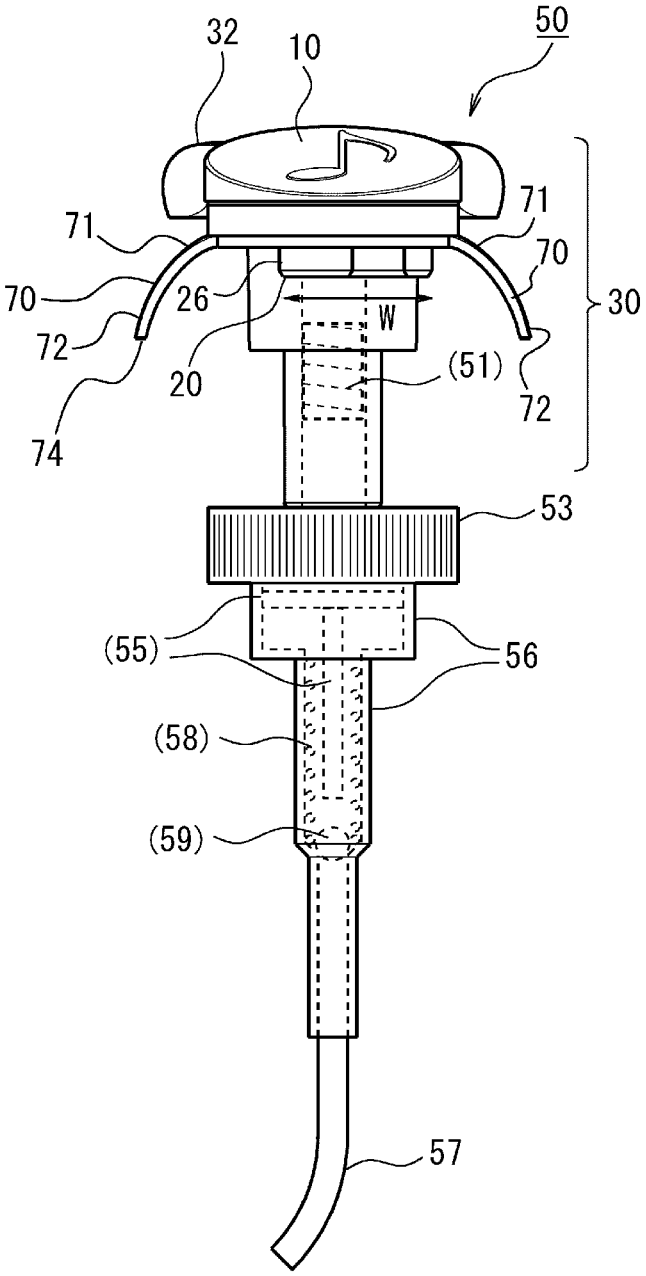
FIG. 19 is a front elevation illustrating a foam delivery mechanism including a head part.

FIG. 16 is a top perspective view of the foam dispensing container 100 according to a third embodiment of this invention, and FIG. 17 is a bottom perspective view of the foam dispensing container 100. FIG. 18A is a plan view of the foam object FB dispensed through the foam dispensing container 100 of this embodiment, and FIG. 18B is a front elevation of the foam object FB. FIG. 19 is a front elevation of the foam delivery mechanism 50 including the head part 30.

The foam dispensing container 100 of the third embodiment is different from the first embodiment in that it has an extension part 70, leaving the other aspects in common.

More specifically, the foam dispensing container 100 of the third embodiment has the container body 40 that reserves the liquid agent L; and the head part 30 that has the outlet 20, and dispenses the liquid agent L delivered from the container body 40 through the outlet 20 into foam. The head part 30 has the dispensing operation part (pump head part 32). The dispensing operation part (pump head part 32) dispenses a predetermined amount of foamy liquid agent (foam B) through the outlet 20, each time the user's operation is accepted. The dispensed foam B is schematically illustrated in FIG. 16 and FIG. 17 with a two dot chain line. The foamy liquid agent (foam B) dispensed through the outlet 20 in the predetermined dispensing direction DD, after one-time or plural times of operations made on the dispensing operation part (pump head part 32), is built up into the desired foam object FB with intended shape as illustrated in FIG. 18A.

The head part 30 of this embodiment has extension parts 70 that extend beyond the front end position of the outlet 20 with respect to the dispensing direction DD.

Since the extension parts 70 extend beyond the front end position of the outlet 20 with respect to the dispensing direction DD, the extension parts 70 may be brought into contact with the dispensing target plane TP, while opposing the outlet 20 to the dispensing target plane TP leaving a space in between. In this way, the distance SP (see FIG. 21) between the outlet 20 and the dispensing target plane TP may be kept at a desired level. More specifically, the extension parts 70, when used by bringing the tips (lower ends) into contact with the dispensing target plane TP, can serve as a spacer between the outlet 20 and the dispensing target plane TP. With such spacer function given to the foam dispensing container 100, conditions for dispensing the foam B through the outlet 20 may be stabilized among the users and the operations. With the outlet 20 whose geometry is preliminarily determined so that the foam object FB with intended shape may be built up on the dispensing target plane TP placed such distance SP away from the outlet 20, it now becomes possible to build up the desired foam object FB with the foam B dispensed upon operations made on the dispensing operation part, in a highly reproducible manner. The extension parts 70 not only function as the spacer as described above, but are also used as described later in a fifth embodiment as a shaping member that adds a pointed part P to the foam object FB (see FIGS. 26A and 26B). More specifically, by placing the extension part 70 so that it can contact with the foam B dispensed through the outlet 20 onto the dispensing target plane TP, the extension part 70 may be used as the shaping member. The extension part 70, intended to be used as the shaping member, may be used in contact with the dispensing target plane TP, or may be used while slightly lifted up above the dispensing target plane TP.

Now the phrase stating that "the dispensed foamy liquid agent (foam B) is built up into the foam object FB with intended shape" means that the foam B dispensed through the outlet 20 is made up into the predetermined shape on the dispensing target plane TP. The intended shape of the foam object FB is not specifically limited, and is exemplified by geometrical shapes, characters' shapes and so forth. The intended shape means at least one of plan view geometry of the foam object FB when seen confronting to the dispensing target plane TP, or a three dimensional steric shape of the foam object FB. The foam object FB with intended shape includes foam objects shaped differently from those dispensed through a single nozzle with a circular cross section having widely been used in public in the foam dispensing container. Such foam objects include those built up after dispensed through a plurality of outlets, and those built up after dispensed through one or plural outlets that are formed by combining circle, rectangle and so forth.

This embodiment exemplifies a foam pump bottle designed to mechanically dispense the liquid agent L from the container body 40, when the pump head part 32 is pressed down. In the foam dispensing container 100 of this embodiment, the piston 55 (see FIG. 19) is driven as described later upon press-down operation made on the pump head part 32, and the liquid agent L having been reserved under normal pressure in the container body 40 is sucked up through the suction tube 57. A seventh embodiment described later exemplifies an electrically driven dispenser that is electrically actuated to dispense the liquid agent L (see FIG. 28). Roughly speaking, the foam dispensing container 100 is composed of the container body 40 that reserves the liquid agent L, and the foam delivery mechanism 50 that is attached to the container body 40 to dispense the liquid agent L.

Figure 21:
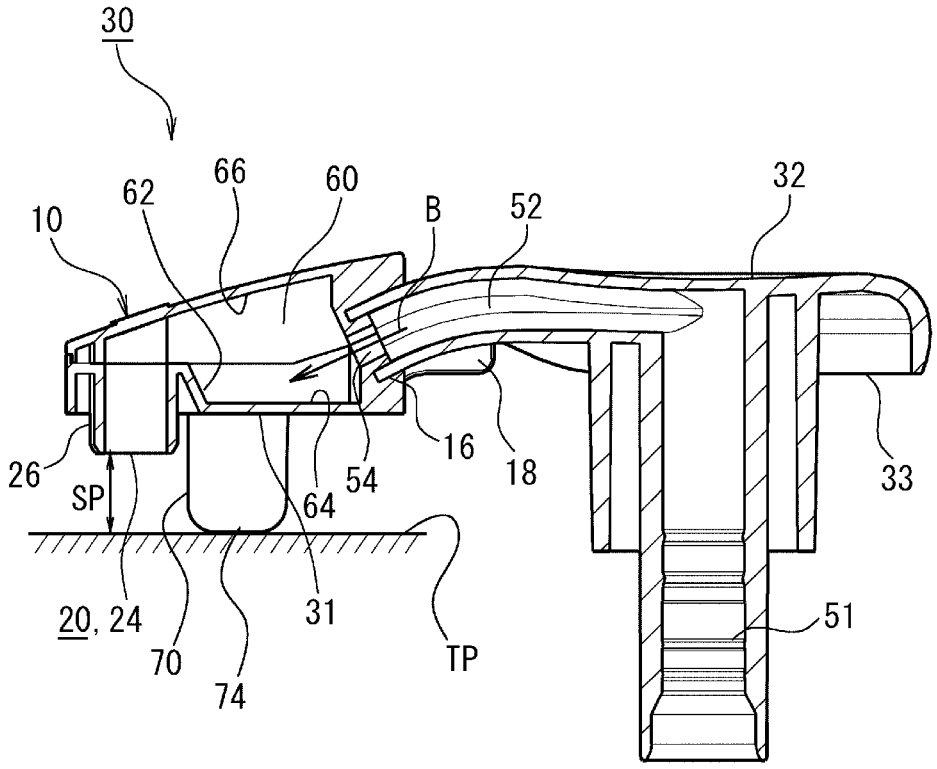
FIG. 21 is a cross-sectional view taken along line VI-VI in FIG. 20.

The head part 30 of this embodiment is configured by detachably combining the pump head part 32 having the nozzle part 52, and the foam dispenser attachment 10 having the outlet 20 (see FIG. 21). Note that, alternatively to this embodiment, the head part 30 may be configured by the outlet 20 and the pump head part 32 that are formed in an integrated manner. With such design, the outlet 20 is prevented from wobbling, and thereby the distance SP between the outlet 20 and the dispensing target plane TP (see FIG. 21), when the pump head part 32 is pressed down with the extension parts 70 kept pressed against the dispensing target plane TP, is prevented from varying contingently.

The outlet 20 is formed so as to be opened downward in a bottom face 31 of the head part 30, at a position (on the distal side) laterally projected out from the bottleneck 44 of the container body 40. The dispensing direction DD of the foam B dispensed through the outlet 20 of this embodiment is downward, so that a downward view will now be referred to as a plan view. The foam B dispensed through the outlet 20 and exposed to the air descends towards the dispensing target plane TP (see FIGS. 18, 21), while being modeled after the outlet 20 as a whole, but locally swells in the individual portions to build up the foam object FB. The foam object FB may be built on the dispensing target plane TP after fallen from the outlet 20 and downwardly away from the outlet 20, or may be built so as to fill the space between the outlet 20 and the dispensing target plane TP. For the latter case, the level of height of the top face of the foam object FB is preferably equal to or higher than the outlet 20, and lower than the bottom face 31 of the head part 30, from the viewpoint of stably building up the foam object FB into the desired intended shape.

The dispensing target plane TP is a flat plane or a curved plane on which the foam object FB is built up. Although a user's palm is exemplified in FIG. 18A, this is also exemplified by surfaces of various application tools such as sponge, brush and so forth. For pointed bristles of brush, a flat plane or curved plane given by a set of pointed bristles will be referred to as the dispensing target plane TP.

Now the dispensing direction DD of the foam B means an overall direction of the foam B dispensed through the outlet 20. The dispensing direction DD is determined by various factors. The factors include flow direction of the foam B that passes through the outlet 20, an angle formed between the flow direction and the direction the outlet 20 opens, an angle between the direction of gravity and the direction the outlet 20 opens, and rate of swelling of the foam B that swells after dispensed through the outlet 20 and exposed to the air.

The head part 30 has the extension parts 70 that extend beyond the front end position of the outlet 20 with respect to the dispensing direction DD. The "front end position of the outlet 20 with respect to the dispensing direction DD" means the frontmost position, in the dispensing direction DD, of the circumferential wall (inner circumferential face of the dispensing guide 26) that partitions the outlet 20. The inner circumferential face of the dispensing guide 26 is the wall with which the foam B dispensed through the outlet 20 comes into contact.

The normal line of the outlet 20 of this embodiment (downward in FIG. 19) agrees with the dispensing direction DD, and the front end position of the outlet 20 with respect to the dispensing direction DD is kept at constant over the entire portion of the outlet 20. The normal line of the outlet 20 and the dispensing direction DD can agree also for the case where both of them are directed obliquely downward or laterally, besides the case of this embodiment where both are directed downward.

For the case, as an alternative to this embodiment, where the normal line of the outlet 20 crosses the dispensing direction DD, the front end position of the outlet 20 in the dispensing direction DD is given by the frontmost point, in the dispensing direction DD, of the circumferential wall that partitions the outlet 20. The cases where the normal line of the outlet 20 crosses the dispensing direction DD include, for example, the case where the outlet 20 was formed by beveling the tip of the tubular dispensing guide 26 (see FIG. 19) like an injection needle, or the case where the outlet 20 is formed to have curved face.

The phrase stating that the "extension parts 70 extend beyond the front end position of the outlet 20 with respect to the dispensing direction DD" means that at least a part of the extension parts 70 is positioned ahead of the front end position of the outlet 20 with respect to the dispensing direction DD. The extension parts 70 of this embodiment are formed so as to extend, relative to the outlet 20, from the rear side to the front side in the dispensing direction DD. At least the front ends 74 of the extension parts 70 are positioned below the outlet 20, and in other words, positioned ahead in the dispensing direction DD beyond the front end position of the outlet 20.

The extension parts 70 in this embodiment are fixed in terms of positional relation relative to the outlet 20. With such design, the extension parts 70 are prevented from moving relative to the outlet 20 even when pressed against the dispensing target plane TP, and can keep the distance SP (see FIG. 21) between the outlet 20 and the dispensing target plane TP at a desired level.

The extension parts 70 in this embodiment, illustrated in FIG. 19, are arranged outside the inner circumferential face of the dispensing guide 26, so that the foam B dispensed through the outlet 20 falls down on the dispensing target plane TP without making contact with the extension parts 70. The extension parts 70 may be formed integrally with the outer circumferential face of the dispensing guide 26, or may be formed separately from the dispensing guide 26. The extension parts 70 in this embodiment are formed separately from the dispensing guide 26, outside in the width direction of the dispensing guide 26 and away therefrom.

As illustrated in FIG. 17, the outlet 20 is formed so as to be opened at the bottom end of the dispensing guide 26 provided to the lower portion of the head part 30 (more specifically, the reservoir 60: see FIG. 21). The dispensing guide 26 is provided so as to suspend down from the bottom face 31 of the head part 30, and so as to surround the circumference of the outlet 20 like a wall. This prevents the foam B from adhering to the undersurface of the head part 30, making the foam B more releasable, and making it possible to build up a finely-profiled foam object FB. Note, however, that this invention is not limited thereto, wherein the dispensing guide 26 may be buried in the wall of the bottom face 31 of the head part 30. For example, the bottom face 31 may be made thick, and a through-hole formed so as to extend through the bottom face 31 may be used as the dispensing guide 26.

The normal line of the outlet 20 (opening) lies parallel to the direction the dispensing guide 26 suspends down. The dispensing direction DD in the foam dispensing container 100 of this embodiment therefore lies in the direction of normal line of the outlet 20 (opening), which directs downward as indicated by an arrow in FIG. 17.

As illustrated in FIG. 17, the extension parts 70 in this embodiment are provided outside the region where the foamy liquid agent (foam B) dispensed through the outlet 20 passes. In FIG. 18A, footing regions FP of the palm, as the dispensing target plane TP, where the front ends 74 of the extension parts 70 are brought into contact are indicated by two dot chain lines. The footing regions FP are located outside the building region of the foam object FB, and the extension parts 70 are located outside the building region of the foam object FB with intended shape. Now the "front ends 74 of the extension parts 70" mean the lower end faces of the extension parts 70. By making the extension parts 70 flattened on the front ends 74 thereof, the extension parts 70 may be brought into contact stably with the dispensing target plane TP. The front ends 74 of the extension parts 70 may however be given curved faces that are slightly rounded, in consideration of gentle touch on the user's palm.

The front ends 74 of the extension parts 70 are formed within a region that may be encompassed within the palm of one hand of the user (at least adult male). Positions of the base portions and front ends of the extension parts 70 may be determined depending on geometry or size of the outlet 20.

The extension parts 70 are preferably provided at a plurality of discrete positions around the outlet 20. More preferably, a pair of extension parts 70 are opposingly formed on both sides of the outlet 20, and so as to project out from the circumferential face of the foam dispenser attachment 10.

The extension parts 70 of this embodiment are integrally formed with the foam dispenser attachment 10 using a single material. With this design, the extension parts 70 will not be detached from the foam dispenser attachment 10, even when the extension parts 70 are kept pressed against the dispensing target plane TP and applied with drag from the target plane TP as a result of press-down operation made on the pump head part 32. However, as a modified example of this embodiment, the extension parts 70 may be detachably attached to the foam dispenser attachment 10. In other words, the extension parts 70 may have a detachable engagement part adapted to the foam dispenser attachment 10. The detachable engagement part is exemplified by a claw part that grasps the foam dispenser attachment 10, and an adhesive tape used for adhesive fixation to the foam dispenser attachment 10. With the extension parts 70 made detachable from the head part 30, whether the foam dispenser attachment 10 should have a function of spacer or shaping member attributable to the extension parts 70, or not, is now a matter of choice. Alternatively, the existing foam dispenser attachment will have a function of spacer or shaping member, by attaching the extension parts 70 as add-ons.

As illustrate in FIG. 19, the extension parts 70 are formed so as to diverge as they depart from the outlet 20 with respect to the dispensing direction DD (downward in this drawing). The pair of extension parts 70 of this embodiment are preferably formed so as to project out from the circumferential face of the foam dispenser attachment 10, and to suspend down diagonally while being curved. More preferably, bottom end parts 72 of the extension parts 70 rise more steeply than top end parts 71. In other words, the pair of extension parts 70 are formed so as to abruptly expand the opposing distance between the top end parts 71, and so as to rise almost normally to the horizontal plane (dispensing target plane TP: see FIG. 21) at the bottom end parts 72. With such design, the foam B is prevented from contacting with, and adhering to the top end parts 71, even if the foam B dispensed through the outlet 20, upon being exposed to the air, should swell right under the outlet 20. The foam object FB, when built up on the dispensing target plane TP, is also prevented from contacting with the bottom end parts 72. The foam object FB can therefore be formed into the desired intended shape in a stable manner.

It suffices that the front ends of the extension part 70 of the this embodiment, when viewed from the front of the dispensing direction DD confronting to the outlet 20, reside outside the closed area that surrounds the outlet 20, and the position thereof is not specifically limited. The pair of extension parts 70 of this embodiment are formed outside the outlet 20, and on both sides thereof away from each other in the width direction (the lateral direction in FIG. 19) that crosses the distal-proximal direction connecting the container body 40 and the outlet 20. An intermediate part 78 (see FIG. 16) that resides between the pair of extension parts 70 and on the distal side (on the front side of the sheet of FIG. 19) of the outlet 20 is opened wider than the width of formation W of the outlet 20. With such design, after the foam object FB with intended shape was built on the dispensing target plane TP, the dispensing target plane TP (palm) may easily be brought away from the foam dispenser attachment 10 without letting the extension parts 70 contact the thus built foam object FB. More specifically, it is recommendable to elevate the pressed-down foam dispenser attachment 10 from the dispensing target plane TP so as to take the extension parts 70 away from the dispensing target plane TP, and then to take out the foam object FB from under the foam dispenser attachment 10 through or just under the intermediate part 78 where the extension parts 70 are not formed. Alternatively, it is also recommendable to, before the pressed-down foam dispenser attachment 10 is elevated, the dispensing target plane TP is brought down relative to the foam dispenser attachment 10 to take the extension parts 70 away from the dispensing target plane TP, and then to take out the foam object FB together with the dispensing target plane TP. In these ways, the foam object FB is prevented from being deformed due to contact with the extension parts 70. When dispensing the foam B, the space between the dispensing target plane TP and the foam dispenser attachment 10 can be seen through the intermediate portion 78 that is kept open without the extension parts 70 formed therein. With such design, the user can visually observe that a sufficient amount of foam B is dispensed on the dispensing target plane TP to build up the foam object FB.

The outlet 20 of this embodiment has the shape identical to that of the first embodiment, and is composed of an opening that has the contiguous geometry narrowed from the intended shape of the foam object FB. As an alternative to this embodiment, the outlet 20 may be composed of a plurality of discretely arranged openings, in the same way as in the foam dispenser attachment 13 described later in a sixth embodiment.

The linear narrowly-opened part 22 may be a contiguous long opening as described above, or may be composed of discrete openings arranged in line. With intervals of such discreteness adjusted to a predetermined value or below, the foams B dispensed through such plurality of openings arranged in line will be crowded together on the dispensing target plane TP to build up the a contiguous linear foam object FB.

Figure 20:
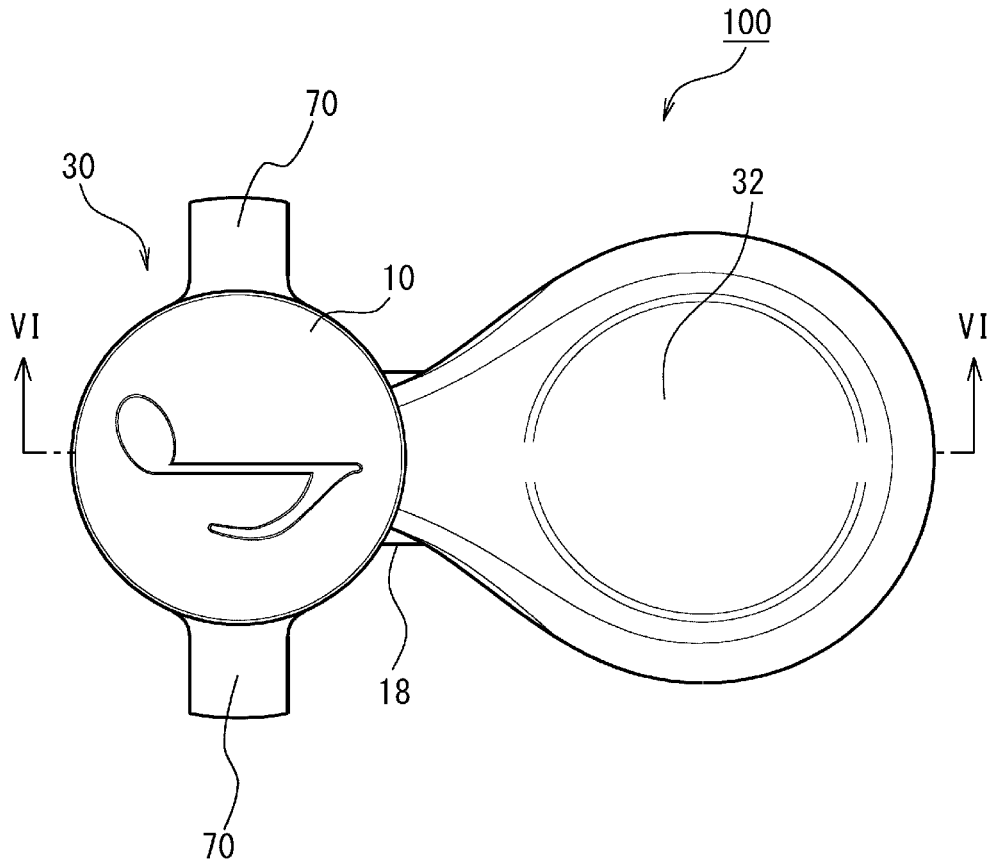
FIG. 20 is a plan view illustrating the head part.
Figure 22:
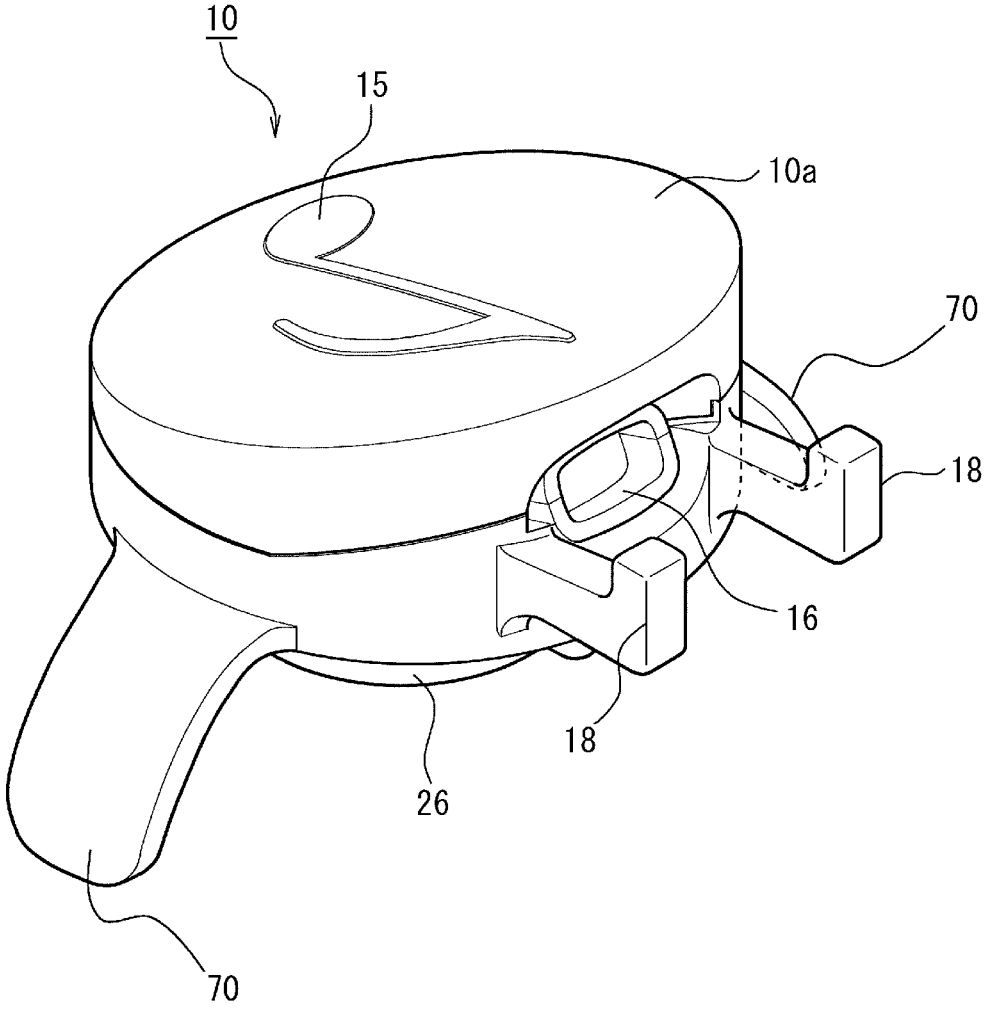
FIG. 22 is a perspective view illustrating a foam dispenser attachment of the third embodiment.
Figure 23A:
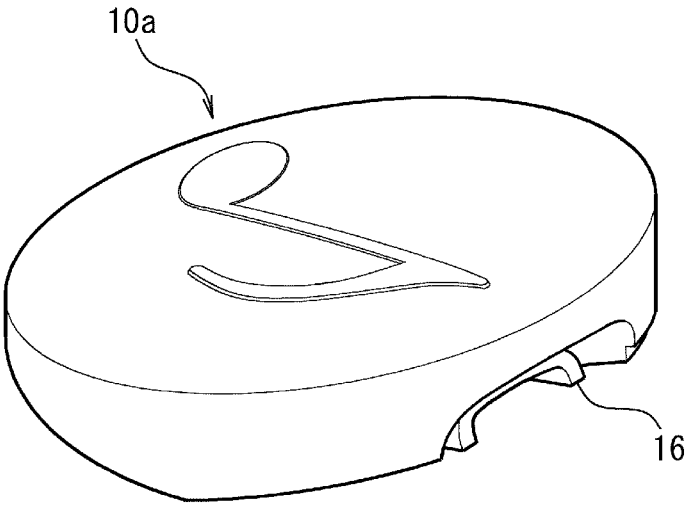
FIG. 23A is a top perspective view illustrating an upper half of the foam dispenser attachment.
Figure 23B:
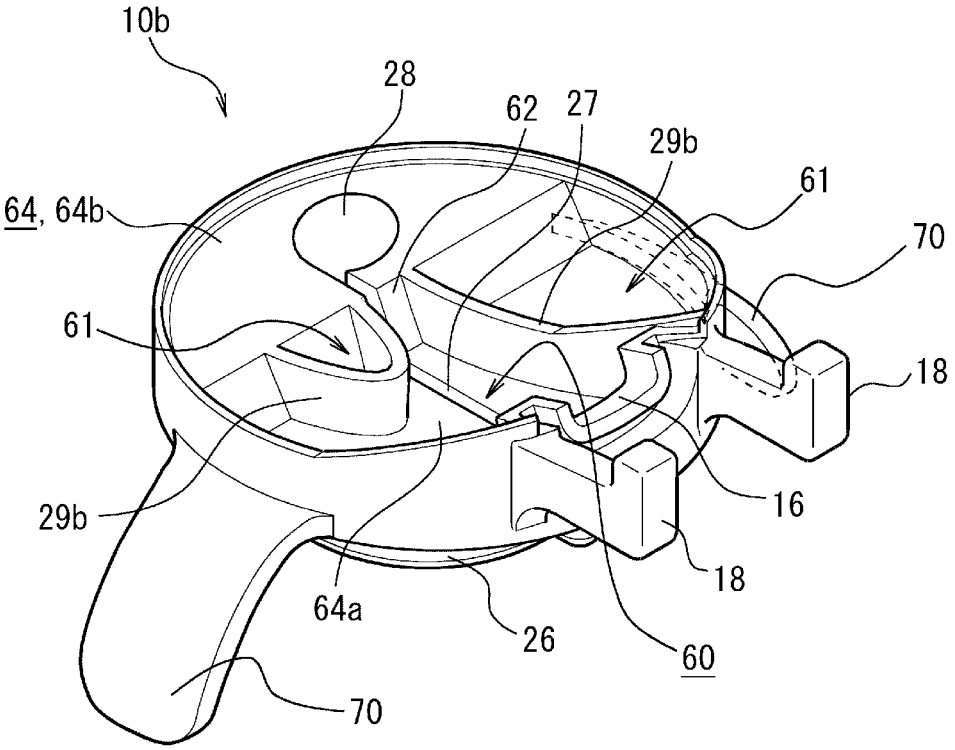
FIG. 23B is a top perspective view illustrating a lower half.

FIG. 20 is a plan view of the head part 30. FIG. 21 is a cross-sectional view taken along line VI-VI in FIG. 20, and is a sectional side elevation of the head part 30. FIG. 22 is a perspective view of the foam dispenser attachment 10. FIG. 23A is a top perspective view of the upper half 10*a* of the foam dispenser attachment 10, and FIG. 23B is a top perspective view of the lower half 10*b*.

As illustrated in FIG. 19 to FIG. 21, the head part 30 of this embodiment is configured by combining the nozzle part 52 (see FIG. 21) and the foam dispenser attachment 10.

The foam dispenser attachment 10 accepts the foamy liquid agent (foam B) dispensed through the nozzle opening 54, and dispenses it through the outlet 20 in the predetermined dispensing direction DD, to thereby build up the foam object FB with intended shape. The foam dispenser attachment 10 of this embodiment has the above-described extension parts 70 that extend beyond the front end position of the outlet 20 with respect to the dispensing direction DD.

As illustrated in FIG. 21 and FIG. 22, the foam dispenser attachment 10 has the fitting part 16 to which the nozzle opening 54 (see FIG. 22) is inserted, and the engagement part 18 that detachably engages with the nozzle part 52 (see FIG. 21). As illustrated in FIG. 17, the pump head part 32 of this embodiment has an umbrella-like shape, and the circumference 33 of the pump head part 32 suspends downward. The engagement part 18 of the foam dispenser attachment 10 engages with the circumference 33 of the pump head part 32 particularly on both sides of the nozzle part 52. With such design, the foam dispenser attachment 10 attached to the pump head part 32 is prevented from inclining back and forth, or left and right relative to the pump head part 32. The foam dispenser attachment 10 will therefore not incline or come off contingently, even when the pump head part 32 was pressed down while keeping the front ends 74 of the extension parts 70 pressed against the dispensing target plane TP.

<Method of Producing Foam Object>

Next, a method of producing a foam object (occasionally referred to as "the present method", hereinafter) according to an embodiment of this invention will be explained.

The present method relates to a method by which the foam B is dispensed from the foam dispensing container 100 (see FIG. 17) to build up the foam object FB (see FIG. 18A and FIG. 18B). The foam object FB is built on the dispensing target plane TP. The foam dispensing container 100 is a foam pump bottle, and has, as described above, the container body 40 that reserves the liquid agent L, and the head part 30 that dispenses the liquid agent L delivered from the container body 40 through the outlet 20 into foam by predetermined portions, each time the user's press-down operation is accepted. The head part 30 has the pump head part 32 that accepts the user's press-down operation.

The present method includes an arrangement step and a dispensing step. In the arrangement step, the dispensing target plane TP is opposed to the outlet while keeping a predetermined distance SP in between. In the dispensing step, the foamy liquid agent (foam B) is dispensed through the outlet 20 onto the dispensing target plane TP so as to build up a foam object FB with intended shape, by pressing down the head part 30 and by concurrently lowering the dispensing target plane TP while keeping the predetermined distance SP in between.

With such design, since the foam B is dispensed through the outlet 20 while keeping a predetermined distance SP between the outlet 20 and the dispensing target plane TP, so that the state of foam B after dispensed and reaches the dispensing target plane TP will be reproducible, and the foam object FB with the desired intended shape may be built up repetitively.

The foam B dispensed through the outlet 20 has a small shape retention, and may swell upon being exposed to the air, or can be rounded up into ball shape. The shape of the resultant foam object FB can therefore easily vary, just by changing the distance between the outlet 20 and the dispensing target plane TP such as user's palm. In contrast, according to the foam dispensing container 100, the foam dispenser attachment 10, and the method of producing a foam object of this embodiment, the foam object FB that is built up on the dispensing target plane TP upon each dispensing operation made by the user will enjoy an improved reproducibility of shape. Thus the foam object FB may be built up into the desired intended shape in a highly accurate manner.

The present method may also perform a elevation step in which the pressed-down head part 30 and the lowered dispensing target plane TP are elevated while keeping the distance SP in between, and a dispensing step again. Since the distance between the dispensing target plane TP and the outlet 20 is kept constant over the elevation step and the plural times of dispensing steps, so that the desired foam object FB with intended shape may be built up with the foams B dispensed in the plural times of dispensing steps in a highly reproducible manner. At least the arrangement step of the present method is preferably carried out while mutually joining the head part 30 and the dispensing target plane TP (see FIG. 21). Preferably, in the arrangement step and the dispensing step, the head part 30 and the dispensing target plane TP are joined to each other. In this way, in the dispensing step, the head part 30 and the dispensing target plane TP may easily be brought down in an interlocked manner, so that the distance SP between the outlet 20 and the dispensing target plane TP may be kept constant easily.

As described above, the head part 30 has the extension parts 70 that extend beyond the front end position of the outlet 20, with respect to the dispensing direction DD the foamy liquid agent (foam B) is dispensed through the outlet 20. In the arrangement step and the dispensing step, by pressing the front ends 74 of the extension parts 70 against the dispensing target plane TP so as to mutually join the head part 30 and the dispensing target plane TP, the outlet 20 and the dispensing target plane TP are kept at a predetermined distance SP (see FIG. 21). In this way, the distance SP may be kept stably during the press-down operation made on the head part 30. Although mode of joining of the head part 30 and the dispensing target plane TP is not specifically limited, the front ends 74 of the extension parts 70 may be brought into contact with the surface of the dispensing target plane TP as in the present method. Alternatively, the dispensing target plane TP may be held by the extension parts 70, or still alternatively, the extension parts 70 and the dispensing target plane TP may be detachably engaged.

In one modified example of the present method, it is recommendable for the user, in the arrangement step and the dispensing step, to bring his or her fingers of one palm, which is the dispensing target plane TP, into contact with the head part 30, typically in such a way that he or she bends its fingers of one palm upward to hold the head part 30. In this way, the head part 30 and the dispensing target plane TP are linked by aid of the fingers in the arrangement step and the dispensing step, and thereby the outlet 20 and the palm (dispensing target plane TP) may be kept at the predetermined distance SP.

Now other embodiments of the foam dispensing container and the foam dispenser attachment of this invention will be explained. Descriptions that overlap those in the third embodiment will be skipped properly.

Fourth Embodiment

Figure 24A:
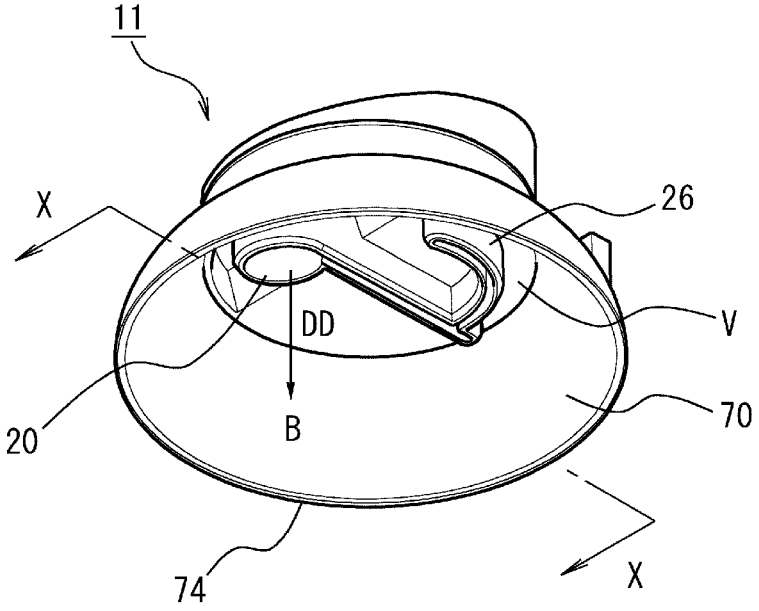
FIG. 24A is a bottom perspective view illustrating a foam dispenser attachment of a fourth embodiment.
Figure 24B:
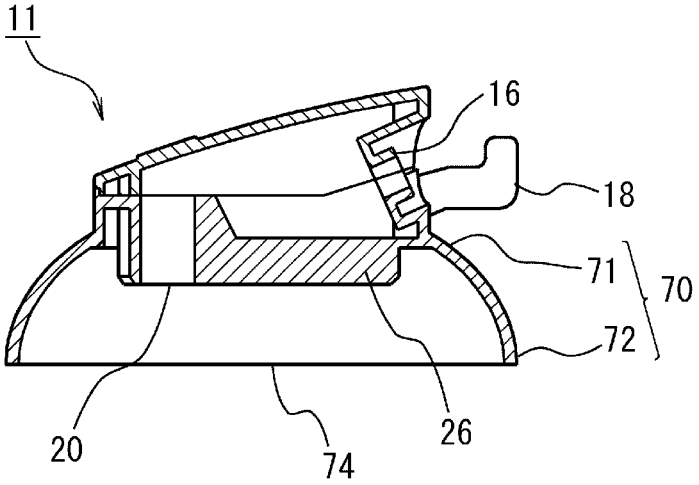
FIG. 24B is a cross-sectional view taken along line X-X in FIG. 24A.

FIG. 24A is a bottom perspective view of a foam dispenser attachment 11 according to a fourth embodiment, and FIG. 24B is a cross-sectional view taken along line X-X in FIG. 24A. The foam dispenser attachment 11 of the fourth embodiment is different from the foam dispenser attachment 10 of the third embodiment in that the extension part 70 is circumferentially provided so as to surround the outlet 20.

The foam dispenser attachment 11 of the fourth embodiment is in common with the foam dispenser attachment 10 of the third embodiment in that the extension part 70 is provided outside the region where the liquid agent (foam B) passes through, and the region where the foam object FB with intended shape (see FIG. 18A and FIG. 18B) is built up. The fourth embodiment and the third embodiment are same also in that the extension part 70 is formed so as to diverge as it departs from the outlet 20 in the dispensing direction DD.

The extension part 70 of this embodiment has a form of partially-sphered cylinder (that is, "dome"), with the top and bottom ends opened. The foam dispenser attachment 11 of this embodiment is same as the foam dispenser attachment 10 of the third embodiment (see FIG. 19) in that, as illustrated in FIG. 24B, the bottom end part 72 of the extension part 70 rises more steeply than the top end part 71.

The aperture of the opening of the top end part 71 of the extension part 70 can totally contain the dispensing guide 26 both in terms of geometry and size, leaving a void V formed between the whole circumference of the dispensing guide 26 and the extension part 70. The aperture of the bottom end part 72 of the extension part 70 can totally contain the intended shape of the foam object FB to be built up (see FIG. 18A and FIG. 18B), and is larger than the intended shape.

With the extension part 70 circumferentially formed as in the fourth embodiment, contact between the dispensing target plane TP (see FIG. 18A and FIG. 18B) and the extension part 70 is stabilized, and thereby the dispensing target plane TP can be confronted accurately to the outlet 20 without being inclined.

Geometry of the circumferential go-around-type extension part 70 is not specifically limited. Although in this embodiment it is given as the partially spherical shape that diverges downward, the shape is not limited thereto. The extension part 70 may have a form of truncated cone, or may have a shape widened or thickened from the geometry of aperture of the outlet 20, or from the dispensing guide 26. The bottom end of the extension part 70 may be circular as shown in this embodiment, or may alternatively have a shape other than circle, such as a rectangular shape, and may have a shape thickened from the geometry of aperture of the outlet 20.

Alternatively, the go-around-type extension part 70 may be made translucent or semi-translucent, entirely or partially. Still alternatively, the extension part 70 may have a peephole provided to a part thereof, or may have a notch at the bottom end thereof. With such design, how the foam object FB was built up may be visually confirmed, before the foam object FB built on the dispensing target plane TP is taken out from the extension part 70.

Fifth Embodiment

Figure 25A:
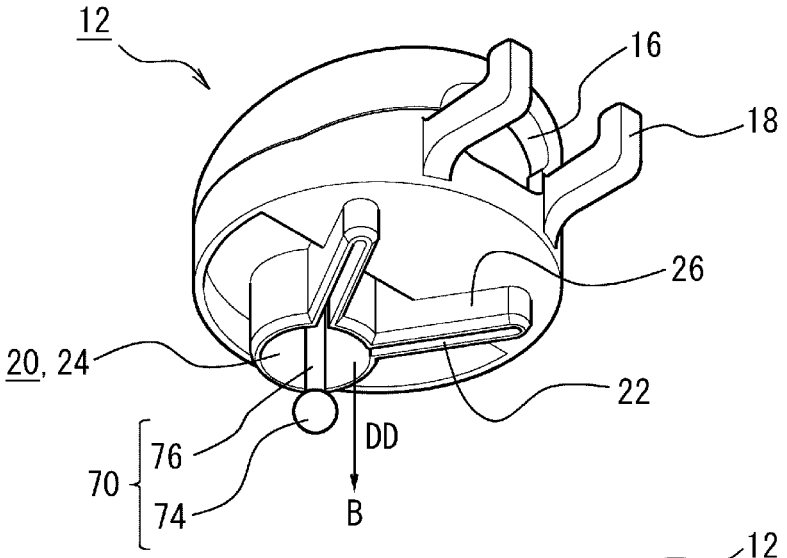
FIG. 25A is a bottom perspective view illustrating a foam dispenser attachment of a fifth embodiment.
Figure 25B:
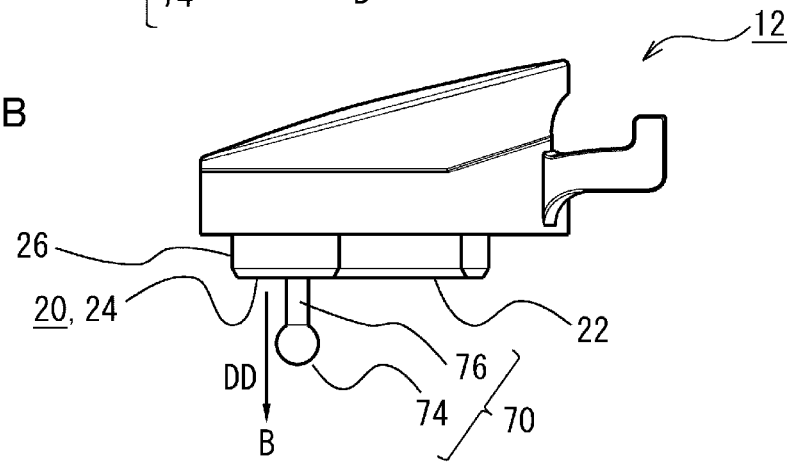
FIG. 25B is a side elevation.

FIG. 25A is a bottom perspective view of a foam dispenser attachment 12 according to a fifth embodiment. FIG. 25B is a side elevation of the foam dispenser attachment 12, and FIG. 25 is a bottom view. FIG. 26A is a plan view of the foam object FB dispensed through the foam dispenser attachment 12 of the fifth embodiment, and FIG. 26B is a perspective view of the foam object FB.

The foam dispenser attachment 12 of the fifth embodiment is different from the foam dispenser attachment 10 of the third embodiment in that at least the front end part 74 of the extension part 70 is provided within the area where the foam object FB with intended shape is built. In other words, the extension part 70 of this embodiment is preferably brought into contact with the foam B dispensed through the outlet 20.

Figure 25C:
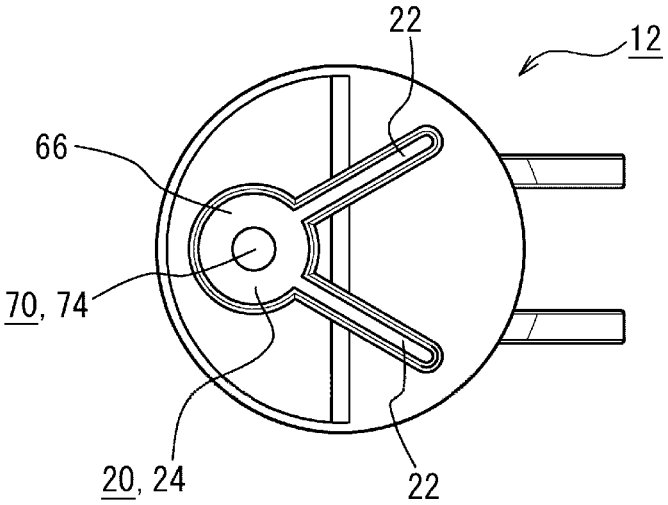
FIG. 25C is a bottom view.
Figure 26A:
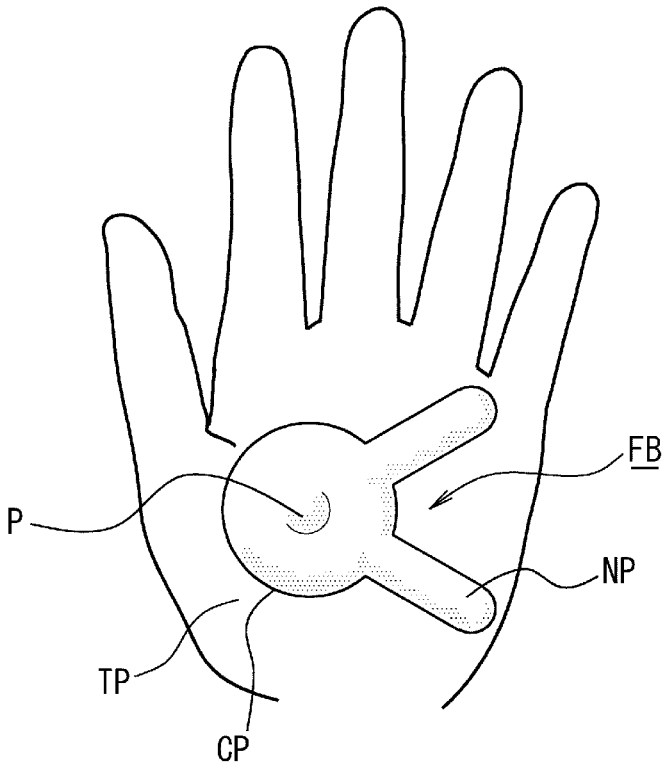
FIG. 26A is a plan view illustrating a foam object dispensed through a foam dispenser attachment of the fifth embodiment.
Figure 26B:
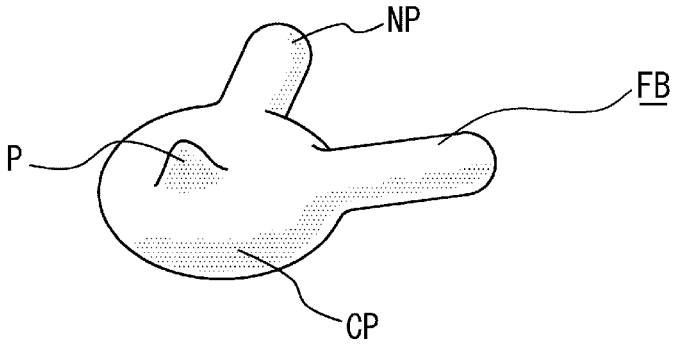
FIG. 26B is a perspective view illustrating a foam object.

The extension part 70 of the fifth embodiment is provided, as illustrated in FIG. 25C, inside the outlet 20 in a plan view in the dispensing direction DD. A part of the foam B dispensed through the outlet 20 therefore streams on the surface of the extension part 70 down onto the dispensing target plane TP.

With such design, when the extension part 70 is drawn out from the built foam object FB, a part of the foam B is dragged up by the extension part 70 while adhering thereto, to produce a pointed part P on the surface of the foam object FB. Accordingly, for an exemplary case as illustrated in FIGS. 26A and 26B where the foam object FB is built up into a shape of animal (rabbit) or other characters, it is now possible to make a projection that represents a nose or so on the foam object FB. In other words, the extension part 70 may be used as a shaping member for creating a three-dimensional portion onto the foam object FB. The extension part 70 of this embodiment is formed inside the inner circumferential face of the dispensing guide 26 with which the foam B dispensed through the outlet 20 comes into contact. The extension part 70 may be formed integrally with the inner circumferential face of the dispensing guide 26, or may be formed separately from the dispensing guide 26. The extension part 70 of this embodiment is arranged at a position inwardly away from the inner circumferential face of the dispensing guide 26, and separately from the dispensing guide 26. With such design, when the projection is formed on the foam object FB by dragging up a part of the foam B adhered to the extension part 70, it is now possible to prevent the contour of the foam object FB from being deformed by the extension part 70.

The extension part 70 of this embodiment may be used as a spacer for keeping the distance SP between the outlet 20 and the dispensing target plane TP (see FIG. 21) to a predetermined value, while bringing the front end part 74 thereof into contact with the dispensing target plane TP. In this way, the extension part 70 of this embodiment can serve both as the shaping member and the spacer.

Alternatively, the foam B may be dispensed while keeping the front end part 74 of the extension part 70 slightly lifted above the dispensing target plane TP, and thus arranged in a contactless manner. In this case, the extension part 70 is not used as the spacer, but may be used solely as the shaping member for creating the pointed part P on the foam object FB.

The extension part 70 of this embodiment has a pillar form as a whole, and is provided in parallel to the dispensing direction DD, so as to project out from the ceiling 66 of the reservoir 60 of the foam dispenser attachment 10 (see FIG. 21). The extension part 70 of this embodiment has the front end part 74, and a rod-like stem part 76 with a diameter shrunk from the front end part 74. With such design, it is now possible to moderate pressure applied to the dispensing target plane TP through the extension part 70, when the front end part 74 is brought into contact with the dispensing target plane TP (see FIG. 18). Since the dispensed foam can contact well with the thick front end part 74, so that the pointed part P may be created with a sufficient amount of foam B, by lifting up the extension part 70 and the foam dispenser attachment 10 from the dispensing target plane TP.

Although the front end part 74 in this embodiment appears spherical, this invention is not limited thereto. The bottom face of the front end part 74 may be formed flat. With such design, the front end part 74 can contact by surface with the dispensing target plane TP, so that the dispensing target plane TP may be confronted stably to the outlet 20. The shape of the front end part 74 is not limited to sphere, but may have various shapes depending on the geometry and size of the pointed part P to be formed on the foam object FB.

The outlet 20 has the linear narrowly-opened part 22, and the widely-opened part 24 that is formed contiguously with the narrowly-opened part 22 and is made wider than the narrowly-opened part 22. The foam B dispensed through the widely-opened part 24 composes a near-circular part CP of the foam object FB, and the foam B dispensed through the narrowly-opened part 22 composes a narrow portion NP of the foam object FB. The extension part 70 is provided within the widely-opened part 24. The stem part 76 of the extension part 70 of this embodiment is vertically arranged nearly at the center of the widely-opened part 24. The extension part 70 can therefore come into contact with the foam object FB nearly at the center of the near-circular part CP, so that the near-circular part CP and the narrow portion NP will not be disturbed in their contours, and the foam object FB is suppressed from being deformed as a whole.

Although a character shape exemplified in the fifth embodiment as the intended shape of the foam object FB was a head of rabbit having two narrow portions NP projected out from the near-circular portion CP, this is merely an instance. For example, in one modified example of the fifth embodiment, at least a part of the intended shape may be configured, in a plan view, by a plurality of near-circular parts CP overlapped with each other. The outlet 20 capable of building up such foam object FB with intended shape may have a plurality of near-circular, widely-opened parts 24 respectively narrowed from the plurality of near-circular parts CP, and a linear narrowly-opened part 22 that mutually connects the widely-opened parts 24. In this case, as with the foam dispenser attachment 12 of the fifth embodiment, the extension part 70 may be provided inside the widely-opened part 24. With such design, the pointed part that typically represents eyes, nose or the like may be formed in the foam object FB having various characters' shapes, within a single or a plurality of near-circular parts CP. In this case, a plurality of extension parts 70 may be provided to the head part 30, and the extension parts 70 may be arranged respectively inside the plurality of widely-opened parts 24.

Sixth Embodiment

Figure 27A:
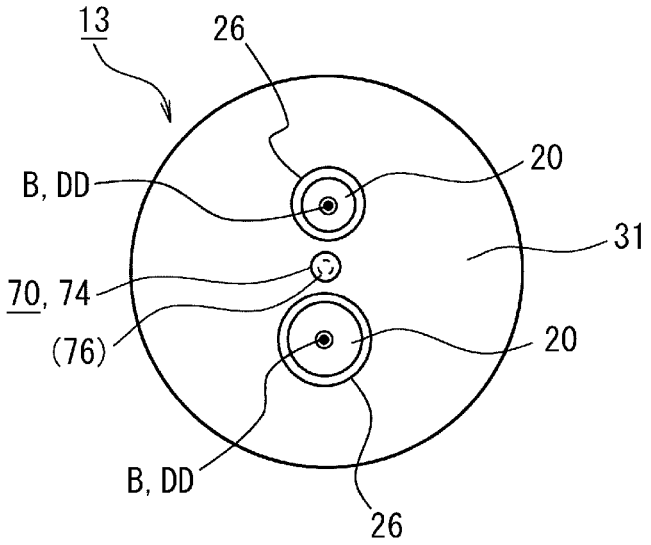
FIG. 27A is a schematic bottom view illustrating a foam dispenser attachment of a sixth embodiment.
Figure 27B:
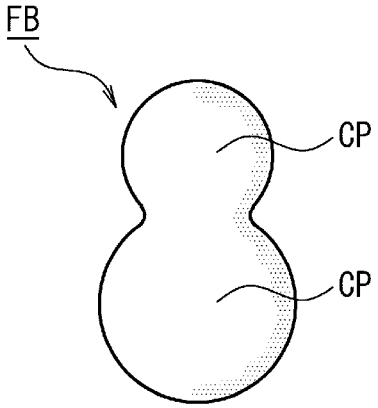
FIG. 27B is a plan view illustrating a built-up foam object.

FIG. 27A and FIG. 27B are schematic bottom views of a foam dispenser attachment 13 of a sixth embodiment. The foam dispenser attachment 13 of the sixth embodiment is different from the foam dispenser attachment 12 of the fifth embodiment, in that the outlet 20 is composed of a plurality of discretely arranged openings. It is also different in that the extension part 70 is provided in a region between the plurality of openings and having no opening formed therein.

The dispensing direction DD of the foam B dispensed through the outlets 20 points frontwards of this sheet of FIG. 27A. The foam B dispensed through the outlets 20 configure the near-circular parts CP in the foam object FB. The distance between the plurality of outlets 20 is preset to a predetermined value, and the plurality of near-circular parts CP are mutually crowded on the dispensing target plane TP (see FIG. 21) to build up a single lump of foam object FB.

Meanwhile, the foam dispenser attachment 13 of this embodiment is same as the foam dispenser attachment 12 of the fifth embodiment in that at least the front end part 74 of the extension part 70 is provided within the area where the foam object FB with intended shape will be built up. The foam dispenser attachment 13 of this embodiment is also same as the foam dispenser attachment 12 of the fifth embodiment, in that the extension part 70 has the front end part 74, and a rod-like stem part 76 made narrower than the front end part 74.

The stem part 76 of the extension part 70 is preferably formed so as to suspend downward from the bottom face 31 of the foam dispenser attachment 13. More preferably, the stem part 76 of the extension part 70 is provided at the middle point relative to the plurality of outlets 20.

According to the foam dispenser attachment 13 of the sixth embodiment, by using the extension part 70 as a spacer so as to be brought into contact with the dispensing target plane TP, the outlet 20 and the dispensing target plane TP are kept at the predetermined distance SP (see FIG. 21), and thereby the foam object FB may be built up with higher reproducibility. When the foams B dispensed through the plurality of outlets 20 to configure the near-circular parts CP are crowded to build the foam object FB, the front end part 74 provided at the middle point of these plurality of outlets 20 contact the foams B. This prevents shortage of the foam B at the middle point. More specifically, while the foam B may be dispensed abundantly right under the plurality of outlets 20, whereas the foam B would sometimes be insufficient at the middle point between the outlets 20. In contrast, when the foams B that swell after dispensed come into contact with the extension part 70, the foams B will be gathered to the middle point to be flattened as a whole, as the extension part 70 is lifted up. That is, the phrase stating that "the extension part 70 is used as a shaping member" includes, not only the case where the pointed part P is created in the foam object FB, but also the case where the foam B is flattened so as to give the intended shape of the foam object FB.

Seventh Embodiment

Figure 28:
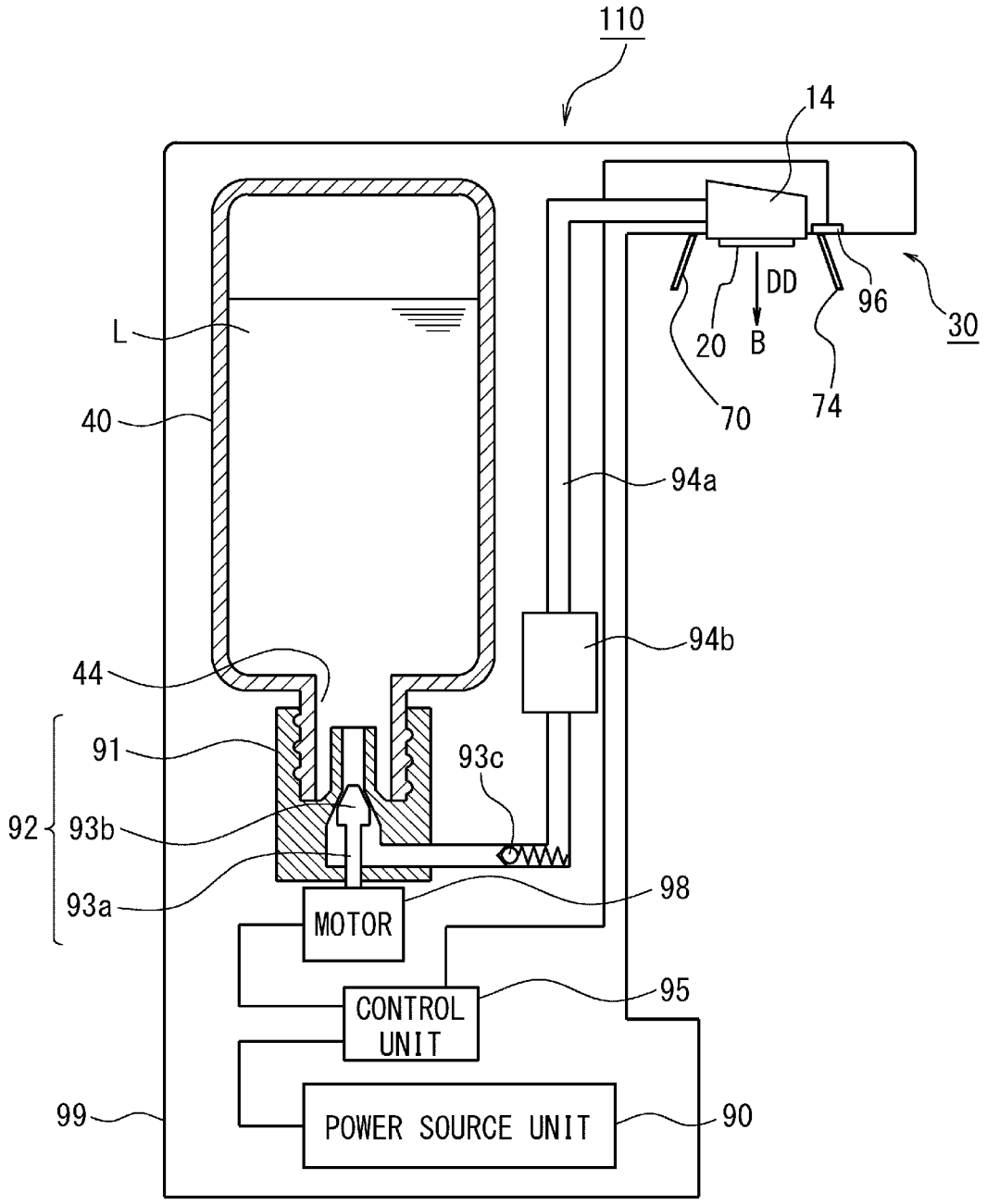
FIG. 28 is an explanatory drawing illustrating a structure of a foam dispensing container of a seventh embodiment.

FIG. 28 is an explanatory drawing illustrating a structure of a foam dispensing container 110 according to a seventh embodiment of this invention. The foam dispensing container 110 of the seventh embodiment is different from the second embodiment in that it has the extension part 70, leaving the other aspects in common.

In the foam dispensing container 110 of this embodiment, the foam dispenser attachment 10 is disposed inside the enclosure 99, leaving the outlet 20 exposed from the enclosure 99. The foam dispenser attachment 10 is provided to the head part 30 that protrudes from the enclosure 99 nearly in the horizontal direction.

The foam dispenser attachment 14 of this embodiment has a pair of extension parts 70 opposed while placing the outlet 20 in between, like the foam dispenser attachment 10 of the third embodiment. The front end parts 74 of the extension parts 70 are positioned below the outlets 20 beyond the front end position thereof, with respect to the dispensing direction DD.

The sensing part 96 has a touch sensor that detects touching on the extension parts 70 or pressing of the extension parts 70. When the user makes his or her palm contact to the front end parts 74 of the extension parts 70, or pushes the front end parts 74 of the extension parts 70 upward by his or her palm with a predetermined force, the sensing part 96 as the touch sensor detects the load of contact or pressurizing, and sends a detection signal to the control unit 95. With such design, the foam B will be dispensed through the outlet 20 when the dispensing target plane TP (palm) comes into contact with the front end parts 74 of the extension parts 70. The distance SP (see FIG. 21) between the outlet 20 and the dispensing target plane TP will thus be kept constant, and the reproducibility of the built-up foam object FB will be improved.

Style of sensing with the sensing part 96 is not limited to as described above, allowing various modifications. For example, for the foam dispensing container 110 used in bright places, the sensing part 96 may detect that the circumstance of the outlet 20 turned dark. In this case, an illuminance sensor is used as the sensing part 96. It is recommendable to provide the extension part 70 that surrounds the circumference of the outlet 20 in a go-around manner, like the foam dispenser attachment 10 of the fourth embodiment illustrated in FIG. 24, to the head part 30. When the sensing part 96 detects that the user brings his or her palm (dispensing target plane TP) into close contact with the bottom end of the extension part 70 to lower the illuminance inside the extension part 70 down to a predetermined threshold level or below, the control unit 95 activates the pump mechanism 92 and makes it dispense a predetermined amount of foamy liquid agent L through the outlet 20.

The embodiments of this invention have been described above referring to the attached drawings, merely as examples of this invention. Various configurations other than those described above may be adoptable.

For example, although the embodiments have exemplified that a lump of foam object FB is built by dispensing, this invention is not limited thereto. When the foam object FB having a plurality of lump portions is built up by dispensing, it is recommendable to configure the outlet with a plurality of partial outlets corresponded to the individual lump portions.

The structures of the nozzle assembly 50 illustrated in FIG. 4 and the foam dispensing container 110 illustrated in FIG. 15 are merely those for exemplary purposes, allowing employment of other various configurations for the mechanism of delivering the liquid agent L having been reserved in the container body 40 to the foam dispenser attachment 10.

The embodiments above have exemplified that the liquid agent L reserved in the liquid form in the container body 40 was introduced into the foam dispenser attachment 10 after transformed into foam. More specifically, the air-liquid contact portion 51 was disposed inside the nozzle assembly 50 in the first embodiment (see FIG. 6), and the air-liquid contact portion **94*b* was disposed in the middle of the tube path 94*a* in the second embodiment (see FIG. 15). Alternatively, the air-liquid contact portion may be provided inside the foam dispenser attachment 10. In other words, the liquid agent L in the liquid form may be introduced from the container body 40 to the foam dispenser attachment 10, transformed into foam within the foam dispenser attachment 10, and then dispensed through the outlet 20. For example, the air-liquid contact portion such as mesh may be provided to the outlet 20**.

A valve may be provided in the vicinity of the outlet 20. The valve may be an on-off valve which is pushed open by the foam B passing through the outlet 20 and is closed upon termination of dispensing of the foam B, which is exemplified by a self-closing valve described in Patent Literature 5 described above. The outlet 20 may preferably be provided inside the dispensing guide 26, or outside the dispensing guide 26 and neighboring thereto so as to cover the outlet 20. Provision of the valve will prevent the liquid agent L that remains within the head part 30 from drying up, and will effectively prevent the outlet 20 from being clogged.

Although the third to sixth embodiments have exemplified the case where the extension part 70 was integrally provided with the foam dispenser attachments 10 to 14 having the outlet 20, this invention is not limited thereto. The foam dispenser attachments 10 to 14 may be configured with a plurality of members, and one member having the outlet 20 and the other member having the extension part 70 may be separately fixed to the head part 30 (pump head part 32).

The fifth and sixth embodiments have exemplified the case where one pillar-like extension part 70 was formed on the foam dispenser attachment 10 so as to protrude in parallel to the dispensing direction DD, or, downward (see FIGS. 25A to 25C and FIGS. 26A to 26B). Alternatively, a plurality of extension parts 70 may be provided to the foam dispenser attachment 10, or the extension part 70 that diagonally lies in the direction crossing the dispensing direction DD may be provided. Provision of the plurality of extension parts 70 will stabilize the direction of the dispensing target plane TP faced to the outlet 20, when the front end parts 74 of the individual extension parts 70 are brought into contact with the dispensing target plane TP.

In conjunction with the embodiments described above, this invention herein will disclose a foam dispensing container and a foam dispenser attachment below.

<1> A foam dispensing container that includes a container body that reserves a liquid agent; a head part that has an outlet, and dispenses the liquid agent delivered from the container body through the outlet into foam; and a dispensing operation part that allows dispensing of a predetermined amount of the foamy liquid agent through the outlet each time it accepts a user's operation, the outlet being an opening with a contiguous geometry narrowed from an intended shape, and being designed to build up the foamy liquid agent, dispensed through the outlet as a result of a single or multiple operations made on the dispensing operation part, into the intended shape in a plan view seen in the dispensing direction.

<2> The foam dispensing container according to <1>, wherein the outlet has a linear narrowly-opened part; and a widely-opened part that communicates with the narrowly-opened part and is made wider than the narrowly-opened part.

<3> The foam dispensing container according to <2>, wherein the widely-opened part is near circular with a diameter larger than a width of the narrowly-opened part.

<4> The foam dispensing container according to any one of <1> to <3>, wherein the head part has a reservoir that reserves the foamy liquid agent delivered from the container body, and the reservoir has a ceiling that inclines towards the front end side of the feeding direction of the liquid agent, and downward towards the outlet.

<5> The foam dispensing container according to <4>, wherein the head part has a nozzle part that dispenses the foamy liquid agent delivered from the container body in an obliquely downward direction into the reservoir; and an inclined face that is provided in the reservoir so as to nearly confront the obliquely downward direction, and the outlet is formed so as to extend between the front end side and the base side of the inclined face.

<6> The foam dispensing container according to <5>, wherein the outlet has a linear narrowly-opened part, and a widely-opened part that communicates with the narrowly-opened part and is made wider than the narrowly-opened part, and the widely-opened part is arranged on the front end side of the inclined face, and the narrowly-opened part is arranged on the base side.

<7> The foam dispensing container according to <5> or <6>, wherein the reservoir has an inner bottom whose level of height is higher on the front end side of the inclined face, than on the base side.

<8> The foam dispensing container according to any one of <4> to <7>, wherein the head part further comprises a dispensing guide that is provided so as to extend downward from the reservoir and has the outlet at the lower end, and the dispensing guide has a straight pipe-like throughhole formed into an identical geometry with the outlet.

<9> The foam dispensing container according to any one of <1> to <8>, wherein the head part has a nozzle part with a nozzle opening through which the foamy liquid agent from the container body is delivered; and a foam dispenser attachment having the outlet, and attached detachably to the nozzle part so that the outlet and the nozzle opening can communicate, and the foam dispenser attachment has a fitting part to which the nozzle opening is inserted, and an engagement part that detachably engages with the nozzle part.

<10> A foam dispenser attachment used while attached detachably to a nozzle part of a foam dispensing container that comprises a container body that reserves a liquid agent; a nozzle part that has a nozzle opening, and dispenses the liquid agent delivered from the container body through the nozzle opening into foam; and a dispensing operation part that allows dispensing of a predetermined amount of the foamy liquid agent through the nozzle opening each time it accepts a user's operation, the foam dispenser attachment having an outlet with a contiguous geometry narrowed from an intended shape, and being designed to accept the foamy liquid agent dispensed through the nozzle opening and to dispense it through the outlet to thereby build up a foam object with the intended shape.

<11> The foam dispensing container according to <3>, wherein the intended shape is at least partially formed so that a plurality of near-circular portions are mutually overlapped in a plan view, and the outlet has a plurality of near-circular, widely-opened parts with diameters respectively shrunk from the plurality of the near-circular portions, and a linear narrowly-opened part that connects the widely-opened parts.

<12> The foam dispensing container according to any one of <1> to <10>, wherein the outlet has a plurality of mutually crossing linear narrowly-opened parts.

<13> The foam dispensing container according to any one of <1> to <10>, wherein the intended shape has at least partially a planar shape in a plan view, the outlet has a series of bent or meandering linear narrowly-opened parts, the narrowly-opened part contains a plurality of line segments arranged in parallel, and the line segments are arranged leaving in between a distance that is preset to allow lumps of the dispensed foamy liquid agent to swell in the width direction to be crowded with each other to give the planar shape.

<14> The foam dispensing container according to <9>, wherein the outlet has a linear narrowly-opened part, and a widely-opened part that communicates with the narrowly-opened part and is made wider than the narrowly-opened part, the dispensing guide has a narrow guide part formed to oppose by sandwiching the narrowly-opened part, and a wide guide part disposed along the widely-opened part, and the narrow guide part and the wide guide part communicate with each other while bounded nearly by the width of the narrow guide part.

<15> The foam dispensing container according to any one of <1> to <8>, wherein the head part is configured to combine a nozzle part with a nozzle opening through which the foamy liquid agent from the container body is delivered; and a foam dispenser attachment having the outlet, and attached detachably to the nozzle part so that the outlet and the nozzle opening can communicate.

<16> The foam dispensing container or the foam dispenser attachment according to <9> or <10>, wherein the foam dispenser attachment has a reservoir that reserves the foamy liquid agent delivered from the container body, and the fitting part is provided so as to be opened at the base side of the reservoir.

<17> The foam dispensing container or the foam dispenser attachment according to <16>, wherein the engagement part is formed so as to project out from the base side of the reservoir and engaged with the nozzle part from the bottom thereof.

<18> The foam dispensing container or the foam dispenser attachment according to any one of <9>, <10>, and <15> to <17>, wherein the foam dispenser attachment is configured by combining an upper half and a lower half to each other, and the lower half has formed therein the outlet.

<19> The foam dispensing container or the foam dispenser attachment according to <18>, wherein the upper half has a wall-like inner guide that surrounds at least a part of circumference of the outlet in a plan view.

<20> The foam dispensing container or the foam dispenser attachment according to <19>, wherein the inner guide surrounds, out of the circumference of the outlet, the front end side thereof in the feeding direction of the liquid agent from the container body to the foam dispenser attachment, and the fitting part is provided on the base side in the feeding direction.

<21> The foam dispensing container according to any one of <1> to <20>, further includes a piston that is attached to the container body while placing a cap in between, and provided so as to move reciprocatively relative to the cap, and a housing that houses the piston and communicates with the outlet, and the dispensing operation part is a pump head part that sucks the liquid agent from the container body up into the housing and dispenses it out through the head part, as a result of reciprocative motion of the piston upon acceptance of a user's press-down operation.

<22> The foam dispensing container according to any one of <1> to <20>, further comprising a power source unit, a pump mechanism that is powered by the power source unit and delivers the liquid agent from the container body, and a control unit that controls operation of the pump mechanism, the dispensing operation part includes a sensing part that detects approach or input operation of a user, and the control unit activates the pump mechanism, based on detection by the sensing part of the approach or input operation of the user, so as to dispense a predetermined amount of the foamy liquid agent through the outlet.

<23> The foam dispensing container according to any one of <1> to <8>, wherein the head part has disposed inside thereof a net body that allows the foamy liquid agent delivered from the container body to pass therethrough.

<24> The foam dispensing container according to <23> citing <8>, wherein the net body is disposed inside the dispensing guide or adjacent to the dispensing guide.

<25> A foam dispensing container-filled product that includes the foam dispensing container according to any one of <1> to <15>, and <21> to <24>, and the liquid agent filled in the container body.

This invention also discloses the foam dispensing container, the foam dispenser attachment and a method of producing the foam object below, in conjunction with the above-described embodiments.

<1A> A foam dispensing container that includes a container body that reserves a liquid agent, and a head part that has an outlet, and dispenses the liquid agent delivered from the container body through the outlet into foam, the head part having a dispensing operation part that allows dispensing of a predetermined amount of the foamy liquid agent through the outlet each time it accepts a user's operation, the foam dispensing container being designed to build up the foamy liquid agent, dispensed through the outlet in a predetermined dispensing direction as a result of a single or multiple operations made on the dispensing operation part, into foam object with an intended shape, and the head part having an extension part that extends beyond the front end position of the outlet with respect to the dispensing direction.

<2A> The foam dispensing container according to <1A>, wherein the extension part is provided outside an area through which the foamy liquid agent dispensed through the outlet passes, and outside an area where the foam object with the intended shape is built up.

<3A> The foam dispensing container according to <2A>, wherein the extension parts are provided at a plurality of discrete positions around the outlet.

<4A> The foam dispensing container according to <2A>, the extension part is circumferentially formed so as to surround the circumference of the outlet.

<5A> The foam dispensing container according to any one of <2A> to <4A>, wherein the extension part is formed so as to diverge as it departs from the outlet in the dispensing direction.

<6A> The foam dispensing container according to <1A>, wherein the extension part is provided so that at least the front end falls in an area where the foam object with the intended shape will be built up.

<7A> The foam dispensing container according to <6A>, wherein the extension part is provided inside the outlet in a plan view seen in the dispensing direction.

<8A> The foam dispensing container according to <6A> or <7A>, wherein the extension part has the front end, and a rod-like stem part formed thinner than the front end.

<9A> The foam dispensing container according to any one of <1A> to <8A>, wherein the outlet is composed of an opening with a contiguous geometry narrowed from the intended shape, or a plurality of discretely arranged openings.

<10A> A foam dispenser attachment used while attached detachably to a nozzle part of a foam dispensing container that comprises a container body that reserves a liquid agent; a nozzle part that has a nozzle opening, and dispenses the liquid agent delivered from the container body through the nozzle opening into foam; and a dispensing operation part that allows dispensing of a predetermined amount of the foamy liquid agent through the nozzle opening each time it accepts a user's operation, and is designed to accept the foamy liquid agent delivered through the nozzle opening and to dispense it through the outlet in a predetermined dispensing direction to thereby build up a foam object with an intended shape, the foam dispenser attachment having an extension part that extends beyond the front end position of the outlet with respect to the dispensing direction.

<11A> A method of producing a foam object, by which a foam object is built up by dispensing a foam from a foam dispensing container that has a container body that reserves a liquid agent, and a head part that dispenses the liquid agent delivered from the container body through an outlet into foam by predetermined portions each time a user's press-down operation is accepted, the method includes an arrangement step for opposing a dispensing target plane to the outlet while keeping a predetermined distance in between; and a dispensing step for dispensing the foamy liquid agent through the outlet onto the dispensing target plane so as to build up a foam object with an intended shape, by pressing down the head part and by concurrently lowering the dispensing target plane while keeping the predetermined distance in between.

<12A> The foam dispensing container according to any one of <1A> to <9A>, wherein the head part is configured to combine a nozzle part with a nozzle opening through which the foamy liquid agent from the container body is delivered; and a foam dispenser attachment having the outlet, and attached detachably to the nozzle part so that the outlet and the nozzle opening can communicate.

<13A> The foam dispensing container according to <12A>, wherein the foam dispenser attachment has a fitting part to which the nozzle opening is inserted, and an engagement part that detachably engages with the nozzle part.

<14A> The foam dispensing container according to any one of <1A> to <8A>, <12A> and <13A>, wherein the outlet has a linear narrowly-opened part, and a widely-opened part that communicates with the narrowly-opened part and is made wider than the narrowly-opened part.

<15A> The foam dispensing container according to <14A>, wherein at least a part of the intended shape is formed so that a plurality of near-circular portions are mutually overlapped in a plan view, and the outlet has a plurality of the near-circular, widely-opened parts with diameters respectively shrunk from the plurality of the near-circular portions, and the linear narrowly-opened part that connects the widely-opened parts.

<16A> The foam dispensing container according to <14A> or <15A>, wherein the extension part is provided inside the widely-opened part.

<17A> The foam dispensing container according to <9A>, wherein the outlet is composed of a plurality of discretely arranged openings, and the extension part is provided in a region between the plurality of openings and having no opening formed therein.

<18A> The foam dispensing container according to <3A>, having a pair of extension parts formed away from each other on both sides in the widthwise direction that crosses the distal-proximal direction connecting the container body and the outlet, and an area that falls between the pair of extension part and on the distal side of the outlet is opened wider than the width of the outlet.

<19A> The foam dispensing container according to <10A> or <13A>, wherein the extension part is detachably attached to the foam dispenser attachment.

<20A> The foam dispensing container according to any one of <1A> to <9A> and <12A> to <19A>, further including a piston that is attached to the container body while placing a cap in between, and provided so as to move reciprocatively relative to the cap, and a housing that houses the piston and communicates with the outlet, and the dispensing operation part is a pump head part that sucks the liquid agent from the container body up into the housing and dispenses it out through the head part, as a result of reciprocative motion of the piston upon acceptance of a user's press-down operation.

<21A> The foam dispensing container according to any one of <1A> to <9A> and <12A> to <19A>, further including a power source unit, a pump mechanism that is powered by the power source unit and delivers the liquid agent from the container body, and a control unit that controls operation of the pump mechanism, the dispensing operation part includes a sensing part that detects approach or input operation of a user, and the control unit activates the pump mechanism, based on detection by the sensing part of the approach or input operation of the user, so as to dispense a predetermined amount of the foamy liquid agent through the outlet.

<22A> The foam dispensing container according to <21A>, wherein the sensing part has a touch sensor that detects touching on the extension part or pressing of the extension part.

<23A> The method of producing a foam object according to <11A>, further including an elevation step for elevating the pressed-down head part and the lowered dispensing target plane while keeping the distance in between, and then repeating the dispensing step.

<24A> The method of producing a foam object according to <11A> or <23A>, wherein in the arrangement step, the head part and the dispensing target plane are joined to each other.

<25A> The method of producing a foam object according to <24A>, wherein the head part has an extension part that extends beyond the front end position of the outlet with respect to the dispensing direction the foamy liquid agent is dispensed through the outlet, and in the arrangement step and in the dispensing step, the outlet and the dispensing target plane are kept at the predetermined distance by pressing the front end of the extension part against the dispensing target plane.

<26A> The method of producing a foam object according to <24A>, wherein in the arrangement step and in dispensing step, by folding fingers of one user's palm, which is the dispensing target plane, to be brought into contact with the head part, the outlet and the one palm are kept at the predetermined distance.

<27A> A foam dispensing container-filled product that includes the foam dispensing container according to any one of <1A> to <22A>, and the liquid agent filled in the container body.

This application claims priority based on Japanese patent application No. 2014-241538 filed on Nov. 28, 2014, Japanese patent application No. 2015-115150 filed on Jun. 5, 2015, and Japanese patent application No. 2015-130405 filed on Jun. 29, 2015, the entire contents of which are incorporated herein by reference.

The invention claimed is:

1. A foam dispensing container comprising:

a container body that reserves a liquid agent; and a head part that has an outlet and dispenses the liquid agent delivered from the container body through the outlet into foam as a foamy liquid agent, wherein the head part having a dispensing operation part that allows dispensing of a predetermined amount of the foamy liquid agent through the outlet each time the dispensing operation part accepts a user's operation, the foam dispensing container is designed to build up the foamy liquid agent, dispensed through the outlet in a predetermined dispensing direction as a result of a single or multiple operations made on the dispensing operation part, into foam object with an intended shape, the head part has an extension part that extends beyond a front end position of the outlet with respect to the dispensing direction, the extension part is provided outside an area through which the foamy liquid agent dispensed through the outlet passes, and outside an area where the foam object with the intended shape is built up, the extension part is formed so as to diverge as the extension part departs from the outlet in the dispensing direction, and a bottom end part of the extension part rises more steeply than a top end part of the extension part.

2. The foam dispensing container according to claim 1, wherein the extension part is provided at a plurality of discrete positions around the outlet.

3. The foam dispensing container according to claim 2, wherein the extension part includes a pair of extension parts formed away from each other on both sides in a widthwise direction that crosses a distal-proximal direction connecting the container body and the outlet, wherein an area that falls between the pair of extension parts and on a distal side of the outlet is opened wider than a width of the outlet.

4. The foam dispensing container according to claim 1, wherein the extension part is circumferentially formed so as to surround a circumference of the outlet.

5. The foam dispensing container according to claim 1, wherein the extension part is provided so that at least a front end falls in an area where the foam object with the intended shape will be built up.

6. The foam dispensing container according to claim 5, wherein the extension part is provided inside the outlet in a plan view seen in the dispensing direction.

7. The foam dispensing container according to claim 5, wherein the extension part has the front end, and a rod-like stem part formed thinner than the front end.

8. The foam dispensing container according to claim 1, wherein the outlet is composed of an opening with a contiguous geometry narrowed from the intended shape, or a plurality of discretely arranged openings.

9. The foam dispensing container according to claim 8, wherein the outlet is composed of a plurality of discretely arranged openings, and the extension part is provided in a region between the plurality of openings and having no opening formed therein.

10. The foam dispensing container according to claim 1, wherein the outlet has a linear narrowly-opened part, and a widely-opened part that communicates with the narrowly-opened part and is made wider than the narrowly-opened part.

11. The foam dispensing container according to claim 10, wherein at least a part of the intended shape is formed so that a plurality of near-circular portions are mutually overlapped in a plan view, and the outlet has a plurality of the near-circular, widely-opened parts with diameters respectively shrunk from the plurality of the near-circular portions, and the linear narrowly-opened part that connects the widely-opened parts.

12. The foam dispensing container according to claim 10, wherein the extension part is provided inside the widely-opened part.

13. The foam dispensing container according to claim 1, further comprising a piston that is attached to the container body while placing a cap in between, and provided so as to move reciprocatively relative to the cap, and a housing that houses the piston and communicates with the outlet, wherein the dispensing operation part is a pump head part that sucks the liquid agent from the container body up into the housing and dispenses the liquid agent out through the head part, as a result of reciprocative motion of the piston upon acceptance of the user's operation.

14. The foam dispensing container according to claim 1, further comprising a power source unit, a pump mechanism that is powered by the power source unit and delivers the liquid agent from the container body, and a control unit that controls operation of the pump mechanism, wherein the dispensing operation part comprises a sensing part that detects approach or input of the user's operation, and the control unit activates the pump mechanism, based on detection by the sensing part of the approach or input, so as to dispense a predetermined amount of the foamy liquid agent through the outlet.

15. The foam dispensing container according to claim 14, wherein the sensing part has a touch sensor that detects touching on the extension part or pressing of the extension part.

16. A foam dispenser attachment used while attached detachably to a nozzle part of a foam dispensing container that comprises:

a container body that reserves a liquid agent;

a nozzle part that has a nozzle opening and dispenses the liquid agent delivered from the container body through the nozzle opening into foam as a foamy liquid agent; and a dispensing operation part that allows dispensing of a predetermined amount of the foamy liquid agent through the nozzle opening each time the dispensing operation part accepts a user's operation, wherein the foam dispenser attachment is designed to accept the foamy liquid agent delivered through the nozzle opening and to dispense the foamy liquid agent through an outlet in a predetermined dispensing direction to thereby build up a foam object with an intended shape, and the foam dispenser attachment having an extension part that extends beyond a front end position of the outlet with respect to the dispensing direction.

17. The foam dispensing container according to claim 16, wherein the foam dispenser attachment has a fitting part to which the nozzle opening is inserted, and an engagement part that detachably engages with the nozzle part.

18. The foam dispensing container according to claim 16, wherein the extension part is detachably attached to the foam dispenser attachment.

19. A foam dispensing container comprising:

a container body that reserves a liquid agent; and a head part that has an outlet and dispenses the liquid agent delivered from the container body through the outlet into foam as a foamy liquid agent, wherein the head part having a dispensing operation part that allows dispensing of a predetermined amount of the foamy liquid agent through the outlet each time the dispensing operation part accepts a user's operation, the foam dispensing container is designed to build up the foamy liquid agent, dispensed through the outlet in a predetermined dispensing direction as a result of a single or multiple operations made on the dispensing operation part, into foam object with an intended shape, the head part has an extension part that extends beyond a front end position of the outlet with respect to the dispensing direction, the extension part is provided outside an area through which the foamy liquid agent dispensed through the outlet passes, and outside an area where the foam object with the intended shape is built up, the extension part is provided at a plurality of discrete positions around the outlet, the extension part includes a pair of extension parts formed away from each other on both sides in a widthwise direction that crosses a distal-proximal direction connecting the container body and the outlet, and an area that falls between the pair of extension parts and on a distal side of the outlet is opened wider than a width of the outlet.

* * * * *